US010913275B2

(12) United States Patent
Kakiuchi et al.

(10) Patent No.: US 10,913,275 B2
(45) Date of Patent: Feb. 9, 2021

(54) LIQUID DISCHARGE HEAD AND METHOD OF MANUFACTURING LIQUID DISCHARGE HEAD

(71) Applicant: BROTHER KOGYO KABUSHIKI KAISHA, Nagoya (JP)

(72) Inventors: Toru Kakiuchi, Aichi-ken (JP); Yasuo Kato, Aichi-ken (JP); Yuichi Ito, Mie-ken (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 70 days.

(21) Appl. No.: 16/211,988

(22) Filed: Dec. 6, 2018

(65) Prior Publication Data

US 2019/0291437 A1 Sep. 26, 2019

(30) Foreign Application Priority Data

Mar. 22, 2018 (JP) ..... 2018-054795

(51) Int. Cl.
*B41J 2/14* (2006.01)
*B41J 2/16* (2006.01)
*B41J 2/165* (2006.01)

(52) U.S. Cl.
CPC ..... *B41J 2/1607* (2013.01); *B41J 2/14201* (2013.01); *B41J 2/14233* (2013.01); *B41J 2/161* (2013.01); *B41J 2/1606* (2013.01); *B41J 2/1642* (2013.01); *B41J 2/16505* (2013.01); *B41J 2002/14241* (2013.01); *B41J 2002/14491* (2013.01)

(58) Field of Classification Search
CPC .... B41J 2/1607; B41J 2/16505; B41J 2/1642; B41J 2/1606; B41J 2/14201; B41J 2/161; B41J 2/1623; B41J 2/1628; B41J 2/1629; B41J 2/1632; B41J 2/1635; B41J 2/1631; B41J 2/1645; B41J 2/1646; B41J 2002/14241; B41J 2002/14419; B41J 2002/14491; B41J 2/14233
See application file for complete search history.

(56) References Cited

U.S. PATENT DOCUMENTS 5,896,150 A * 4/1999 Kobayashi ..... B41J 2/1612 347/54
9,393,785 B2 * 7/2016 Kinoshita ..... B41J 2/14233
2011/0308715 A1 * 12/2011 Fujita ..... B41J 2/161 156/247
2014/0184705 A1 * 7/2014 Wakamatsu ..... B41J 2/164 347/68

FOREIGN PATENT DOCUMENTS

JP 2014-124882 A 7/2014
JP 2014-124883 A 7/2014
JP 2014-124887 A 7/2014

* cited by examiner

*Primary Examiner* — Yaovi M Ameh
(74) *Attorney, Agent, or Firm* — Merchant & Gould P.C.

(57) ABSTRACT

There is provided a method of manufacturing a liquid discharge head, including: forming a stacked body having a structure and a protective member stacked on the structure, providing a first mask on an upper surface of the protective member to cover a through hole; forming a protective film by an atomic layer deposition on a surface defining a liquid flow channel of the stacked body provided with the first mask; and removing the first mask after forming the protective film.

5 Claims, 25 Drawing Sheets

LIQUID DISCHARGE HEAD AND METHOD OF MANUFACTURING LIQUID DISCHARGE HEAD

CROSS REFERENCE TO RELATED APPLICATION

The present application claims priority from Japanese Patent Application No. 2018-054795 filed on Mar. 22, 2018, the disclosures of which is incorporated herein by reference in its entirety.

BACKGROUND

Field of the Invention

The present invention relates to a liquid discharge head and a method of manufacturing liquid discharge head.

Description of the Related Art

An ink-jet recording head which is an example of a liquid discharge head includes a flow channel forming substrate provided with a pressure generating chamber which communicate with a nozzle opening for jetting a liquid, and a piezoelectric actuator which is provided on a surface of the flow channel forming substrate. The ink-jet recording head can discharge (jet or eject) ink droplets from a nozzle by changing a pressure in the pressure generating chamber by deforming a vibration plate of the piezoelectric actuator.

In a case in which a substrate such as the flow channel forming substrate is formed of silicon, the substrate such as the flow channel forming substrate may be eroded by an ink inside the flow channel. To prevent the erosion of the substrate, a known ink-jet recording head includes stacking substrates such as the flow channel forming substrate via an adhesive followed by forming a protective film made of at least one type of material selected from a group of tantalum oxide, hafnium oxide, and zirconium oxide on an inner wall of the flow channel by an atomic layer deposition.

SUMMARY

Generally, a lead electrode (trace) is connected to an electrode of the piezoelectric actuator, and the lead electrode is electrically connected to a circuit board provided with a drive circuit. However, in a known method for manufacturing an ink-jet recording head, the protective film, which is an insulating film, is formed on the lead electrode, which causes a problem that an electrical contact between the lead electrode and the circuit board cannot be made.

Such problem exists not only in an ink-jet recording head but also in liquid discharge heads that jet liquids other than ink.

The present teaching has been made in view of such circumstances, and an object of the present teaching is to provide a manufacturing method for manufacturing easily a liquid discharge head which includes a protective film that is capable of inhibiting a substrate from being eroded by a liquid inside flow channels, and also inhibiting a leakage of liquid, defective jetting of liquid droplets, and exfoliation of stacked substrates, and includes a trace that is capable of making an electric contact with the circuit board, and a liquid discharge head obtained by the manufacturing method.

According to a first aspect of the present teaching, there is provided a method of manufacturing a liquid discharge head, comprising: forming a stacked body having a structure and a protective member stacked on the structure, the structure including a piezoelectric element, a liquid flow channel, and a trace having a first connecting terminal connected to the piezoelectric element, and a second connecting terminal, the protective member protecting the piezoelectric element, and having a lower surface which is facing (opposing) the structure, and an upper surface which is a surface opposite to the lower surface, a through hole running through the lower surface and the upper surface being formed in the protective member, and the structure and the protective member being stacked such that the second connecting terminal of the trace is exposed through the through hole; providing a first mask on the upper surface of the protective member to cover the through hole; forming a protective film by an atomic layer deposition on a surface defining the liquid flow channel of the stacked body provided with the first mask; and removing the first mask after forming the protective film.

According to a second aspect of the present teaching, there is provided a method of manufacturing a liquid discharge head, comprising: forming a stacked body having a piezoelectric element, a trace, a liquid flow channel, a first space, and a second space and a third space which are arranged to sandwich the first space therebetween in a first direction, the piezoelectric element being positioned in at least one of the second space and the third space, the trace having a first connecting terminal and a second connecting terminal, the first connecting terminal of the trace being connected to the piezoelectric element in at least one of the second space and the third space, the second connecting terminal of the trace being positioned in the first space, the first space, the second space, and the third space being sealed separately from one another, or, the second space and the third space being connected, and the connected second and third spaces and the first space are sealed separately; forming a protective film by an atomic layer deposition on a surface defining the liquid flow channel of the stacked body; and making the first space to be unsealed after forming the protective film.

According to a third aspect of the present teaching, there is provided a liquid discharge head, comprising: a vibration plate; a piezoelectric element provided on the vibration plate; a trace formed on the vibration plate and having a first connecting terminal and a second connecting terminal; and a protective member provided on the vibration plate and protecting the piezoelectric element, wherein the protective member has a lower surface facing the vibration plate, an upper surface on a side opposite to the lower surface, and a lateral surface between the lower surface and the upper surface, the lower surface of the protective member has a recess, the piezoelectric element is accommodated in a protective space defined by the recess and the vibration plate, the lateral surface of the protective member has a first surface and a second surface facing the first surface with the protective space being interposed therebetween, the first connecting terminal of the trace is connected to the piezoelectric element in the protective space, the first surface of the protective member is positioned between the first connecting terminal and the second connecting terminal of the trace, a protective film is formed on the second surface of the protective member, and the protective film is not formed on the first surface of the protective member.

According to a fourth aspect of the present teaching, there is provided a liquid discharge head, comprising: a vibration plate; a piezoelectric element provided on the vibration plate; a trace formed on the vibration plate and having a first connecting terminal and a second connecting terminal; and a protective member provided on the vibration plate and protecting the piezoelectric element, wherein the protective member has a lower surface facing (opposing) the vibration plate, an upper surface on a side opposite to the lower surface, and a lateral surface between the lower surface and the upper surface, the lower surface of the protective member has a recess, the piezoelectric element is accommodated in a protective space defined by the recess and the vibration plate, the lateral surface of the protective member has a first surface, and a second surface facing the first surface with the protective space being interposed therebetween, the first connecting terminal of the trace is connected to the piezoelectric element in the protective space, the first surface of the protective member is positioned between the first connecting terminal and the second connecting terminal of the trace, a protective film is formed on the first surface and the second surface of the protective member, and a portion, of the protective film, positioned on the first surface of the protective member has a thickness smaller than a thickness of another portion, of the protective film, positioned on the second surface of the protective member.

According to the method of manufacturing according to the first aspect and the second aspect, it is possible to manufacture easily a liquid discharge head which includes a protective film that is capable of inhibiting erosion of a substrate by a liquid inside flow channels, and also includes a trace that is capable of making an electric contact with a circuit board. Moreover, in the liquid discharge head according to the third aspect and the fourth aspect of the present teaching, inner wall of the flow channel provided at an interior of the liquid discharge head is protected by the protective film, which improves reliability of the liquid discharge head.

BRIEF DESCRIPTION OF THE DRAWINGS

FIG. 2B is a schematic cross-sectional view of the recording head along a line IIB-IIB in

FIG. 2A.

DETAILED DESCRIPTION OF THE EMBODIMENTS

<Liquid Discharge Head>

Figure 1:
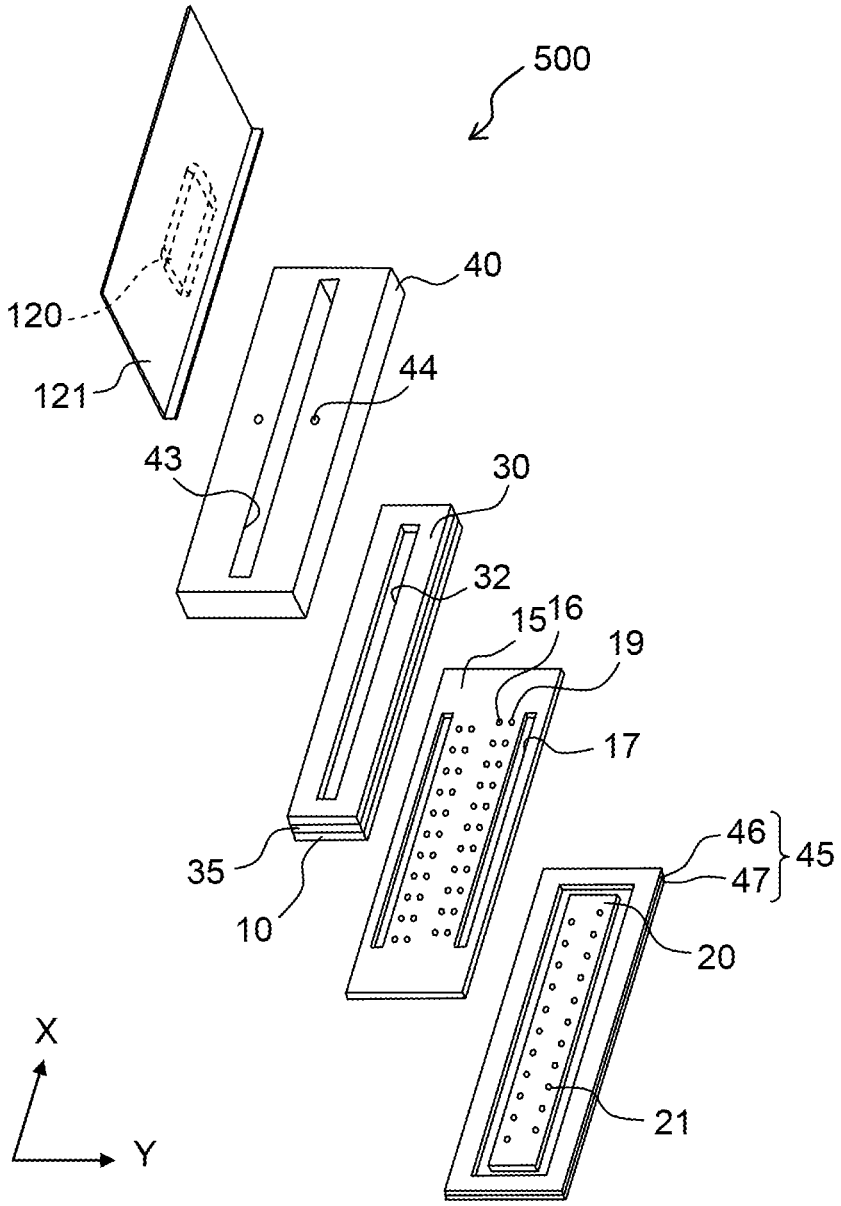
FIG. 1 is an exploded perspective view of a recording head according to an embodiment.

A liquid discharge head according to an embodiment will be described below while referring to FIG. 1, FIG. 2A, and FIG. 2B.

An ink-jet recording head 500 includes some members, and the members are connected by an adhesive, etc. The ink-jet recording head 500 includes a stacked body 25, a circuit board 121, a case member 40, and a compliance substrate 45.

(1) Stacked Body

The stacked body 25 includes a protective member 30, and a structure 37 which includes a flow channel forming substrate (channel substrate) 10, a communicating plate 15, a nozzle plate 20, and a device substrate 35.

As shown in FIG. 1, the channel substrate 10 is a plate material having a rectangular upper surface elongated in an X-direction. The channel substrate 10 is formed of a silicon monocrystalline substrate. Pressure generating chambers 12 are aligned to form a row in a direction in which nozzle openings 21 jetting an ink of same color are aligned. Hereinafter, the direction in which the pressure generating chambers 12 are aligned will be appropriately referred to as 'first direction X'. Moreover, a plurality of rows of the pressure generating chambers 12 along the first direction X may be arranged side-by-side in the channel substrate 10. In the present embodiment, two rows are provided. Hereinafter, a direction, in which the rows of the pressure generating chambers 12 along the first direction X are arranged side-by-side, will be referred to as 'second direction Y'.

The communicating plate 15 and the nozzle plate 20 are stacked in order via an adhesive on a lower surface of the channel substrate 10. In other words, the communicating plate 15 is adhered (glued) via an adhesive 210 to the lower surface of the channel substrate 10, and the nozzle plate 20 is adhered via an adhesive 211 on a surface of the communicating plate 15 on an opposite side of the channel substrate 10.

The nozzle plate 20 is formed of a silicon monocrystalline substrate. Moreover, the nozzle plate 20, as shown in FIG. 1, is a plate material having a rectangular upper surface elongated in the X-direction. As shown in FIG. 1, FIG. 2A, and FIG. 2B, the openings (nozzle openings) 21 communicating with the pressure generating chambers 12 respectively is formed in the nozzle plate 20. In the present embodiment, a surface, of the nozzle plate 20, on an opposite side of a surface adhered to the communicating plate 15, or in other words, a surface from which a liquid such as an ink is jetted, is referred to as a liquid jetting surface 20*a*.

The nozzle openings 21 formed in the nozzle plate 20 are aligned in the first direction X to form a row. Two rows of the nozzle openings 21 along the first direction X are arranged side-by-side in the second direction Y. These two rows (a first row and a second row) of the nozzle openings 21 are provided such that the nozzle openings 21 in the first row and the nozzle openings 21 in the second row are arranged to be staggered. In other words, the position of each of the nozzle openings 21 in the first row is different from the position of each of the nozzle openings 21 in the second row in the first direction X. Two or more than two rows of the nozzle openings 21 may be arranged side-by-side.

A liquid repellent film 24 having a liquid repellent property is provided to the liquid jetting surface 20*a* of the nozzle plate 20. The liquid repellent film 24 is not particularly limited, provided that the liquid repellent film 24 repels ink.

The communicating plate 15 is formed of a silicon monocrystalline substrate. Moreover, the communicating plate 15, as shown in FIG. 1, is a plate material having a rectangular upper surface elongated in the X-direction. As shown in FIG. 1 and FIG. 2B, the communicating plate 15 is provided with a communicating channel (nozzle communicating channel) 16 which connects (establishes communication between) the pressure generating chamber 12 and the nozzle opening 21. Moreover, as shown in FIG. 2B, the communicating plate 15 is provided with a first manifold 17 and a second manifold 18. The first manifold 17 runs through the communicating plate 15 in a direction of thickness of the communicating plate 15 (a direction of stacking of the communicating plate 15 and the channel substrate 10). The second manifold 18 is provided to open on the liquid jetting surface 20*a* of the communicating plate 15 without running through the communicating plate 15 in the direction of thickness of the communicating plate 15. The first manifold 17 and the second manifold 18 communicate each other. Furthermore, the communicating plate 15 is provided with ink supply channels 19, each of which communicates with one end portion in the second direction Y of the pressure generating chamber 12, separately for each pressure generating chamber 12. The ink supply channel 19 establishes communication between the second manifold 18 and the pressure generating chamber 12. Accordingly, the structure 37 has a flow channel formed by the opening 21 provided in the liquid jetting surface 20*a*, the communicating channel 16, the pressure generating chamber 12, the ink supply channel 19, the second manifold 18, and the first manifold 17.

The communicating plate 15 has an area larger than the channel substrate 10, and the nozzle plate 20 has an area smaller than the channel substrate 10. By making the area of the nozzle plate 20 comparatively smaller, it is possible to facilitate cost reduction.

Since the communicating plate 15, the channel substrate 10, and the nozzle plate 20 being formed of a silicon monocrystalline substrate, coefficients of linear expansion of the communicating plate 15, the channel substrate 10, and the nozzle plate 20 are equal. Accordingly, it is possible to prevent warping of the communicating plate 15, the channel substrate 10, and the nozzle plate 20, which occurs due to heating and cooling. The communicating plate 15, the channel substrate 10, and the nozzle plate 20 are not limited to be formed of silicon monocrystalline material but may be formed of other material.

The device substrate 35 is provided to an upper surface positioned at an opposite side of the lower surface of the channel substrate 10. The device substrate 35 includes a vibration plate 50, a lead electrode (trace) 90, and a piezoelectric element 300 including a first electrode 60, a piezoelectric layer 70, and a second electrode 80. The piezoelectric element 300 and the lead electrode 90 are provided on the vibration plate 50. In other words, the device substrate 35 has an arrangement in which, the lead electrode 90 is formed on a substrate including the vibration plate 50 and the piezoelectric element 300.

The vibration plate 50 has a lower surface which is facing (opposing) the channel substrate 10, an upper surface which is a surface positioned opposite to the lower surface and is facing a protective member 30 that is described below, and a lateral surface 50*c* between the upper surface and the lower surface.

The vibration plate 50 includes an elastic film 51 which is provided on the upper surface of the channel substrate 10 and an insulator film 52 which is formed on the elastic film 51.

The piezoelectric element 300 is provided as a pressure generating means on the vibration plate 50. The piezoelectric element 300 and the vibration plate 50 form a piezoelectric actuator. Here, the piezoelectric element 300 means a portion including the first electrode 60, the piezoelectric layer 70, and the second electrode 80. Generally, any one of the first electrode 60 and the second electrode 80 is formed as a common electrode, and the other electrode and the piezoelectric layer 70 are patterned for each pressure generating chamber 12. Moreover, a portion, including the other electrode and the piezoelectric layer 70, in which piezoelectric distortion occurs by applying a voltage to the first electrode 60 and the second electrode 80, is referred to as a piezoelectric active portion. In the present embodiment, the first electrode 60 is formed as the common electrode of the piezoelectric element 300, and the second electrode 80 is formed as an individual electrode of the piezoelectric element 300. However, this may be reversed for the convenience of a drive circuit and wiring. The elastic film 51 of the vibration plate 50 together with the channel substrate 10 defines the pressure generating chamber 12.

The first electrode 60 is provided on the vibration plate 50. The piezoelectric layer 70 is provided on the first electrode 60. The piezoelectric layer 70 is made of a piezoelectric material which is an oxide having a polarized structure, and may be made of a perovskite oxide expressed by a general formula $ABO_3$ for example, where, A may include lead and B may include at least one of zirconium and titanium. B may further include niobium for example. Specifically, as the piezoelectric layer 70, lead zirconate titanate ($Pb(Zr,Ti)O_3$: PZT) and lead zirconate titanate niobate ($Pb(Zr,Ti,Nb)O_3$ may be used. Moreover, the piezoelectric layer 70 may be made of a lead-free piezoelectric material which does not contain lead, such as a composite oxide having a perovskite structure including bismuth ferrate or bismuth manganate ferrate, and barium titanate or bismuth potassium titanate.

The second electrode 80 is provided on the piezoelectric layer 70. A first connecting terminal 90*a* positioned at one end of the lead electrode (trace) 90 is connected to the second electrode 80. The lead electrode 90 extends in the second direction Y from the second electrode 80. A connecting terminal 121*a* of the circuit board 121 is connected to a second connecting terminal 90*b* positioned at the other end of the lead electrode 90.

The vibration plate 50 is not limited to a plate which includes the elastic film 51 and the insulator film 52. For instance, any one of the elastic film 51 and the insulator film 52 may be provided as the vibration plate 50. Moreover, without providing the elastic film 51 and the insulator film 52 as the vibration plate 50, the first electrode 60 may be used as a vibration plate. Moreover, the piezoelectric element 300 may substantially serve as a vibration plate. However, in a case of providing the first electrode 60 directly on the channel substrate 10, it is necessary to protect the first electrode 60 by an insulator film (such as a protective film 200 described below) to prevent the first electrode 60 from coming in contact with ink.

The protective member 30 is adhered on the device substrate 35 via an adhesive (adhesive layer) 212. The protective member 30 has a size substantially same as a size of the channel substrate 10. The protective member 30 is formed of a silicon substrate (silicon monocrystalline substrate). The protective member 30 is not limited to silicon monocrystal but may be formed of some other material.

Figure 2A:
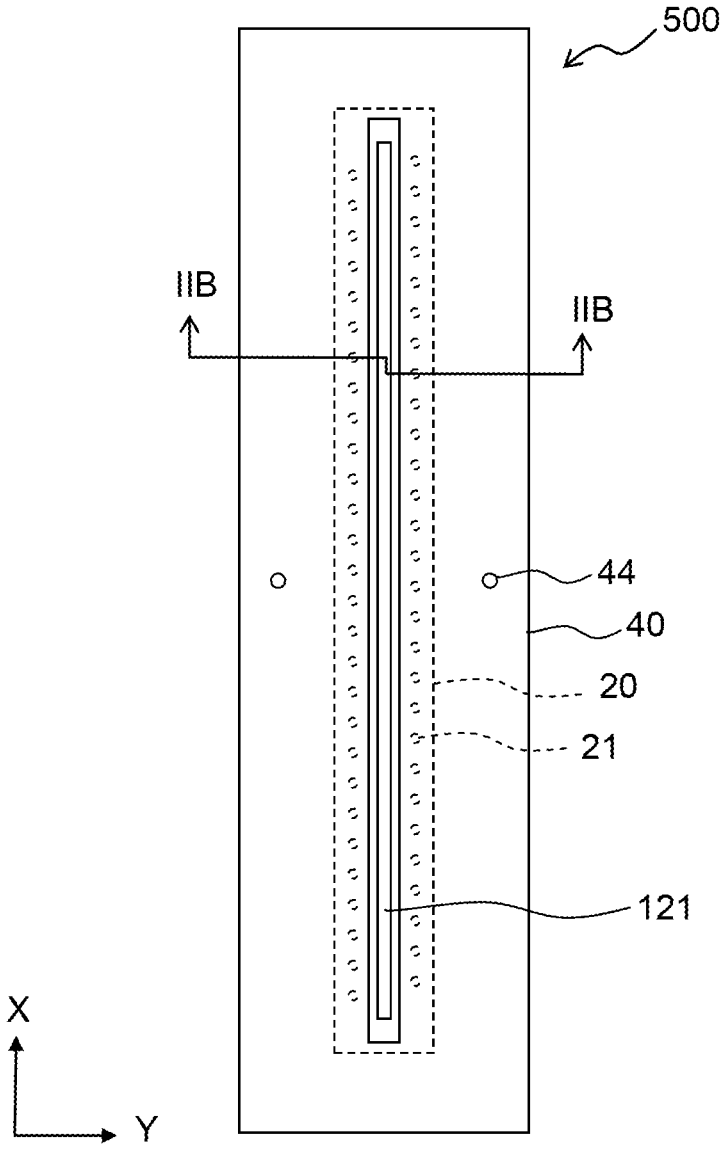
FIG. 2A is a schematic top view of the recording head according to the embodiment.
Figure 2B:
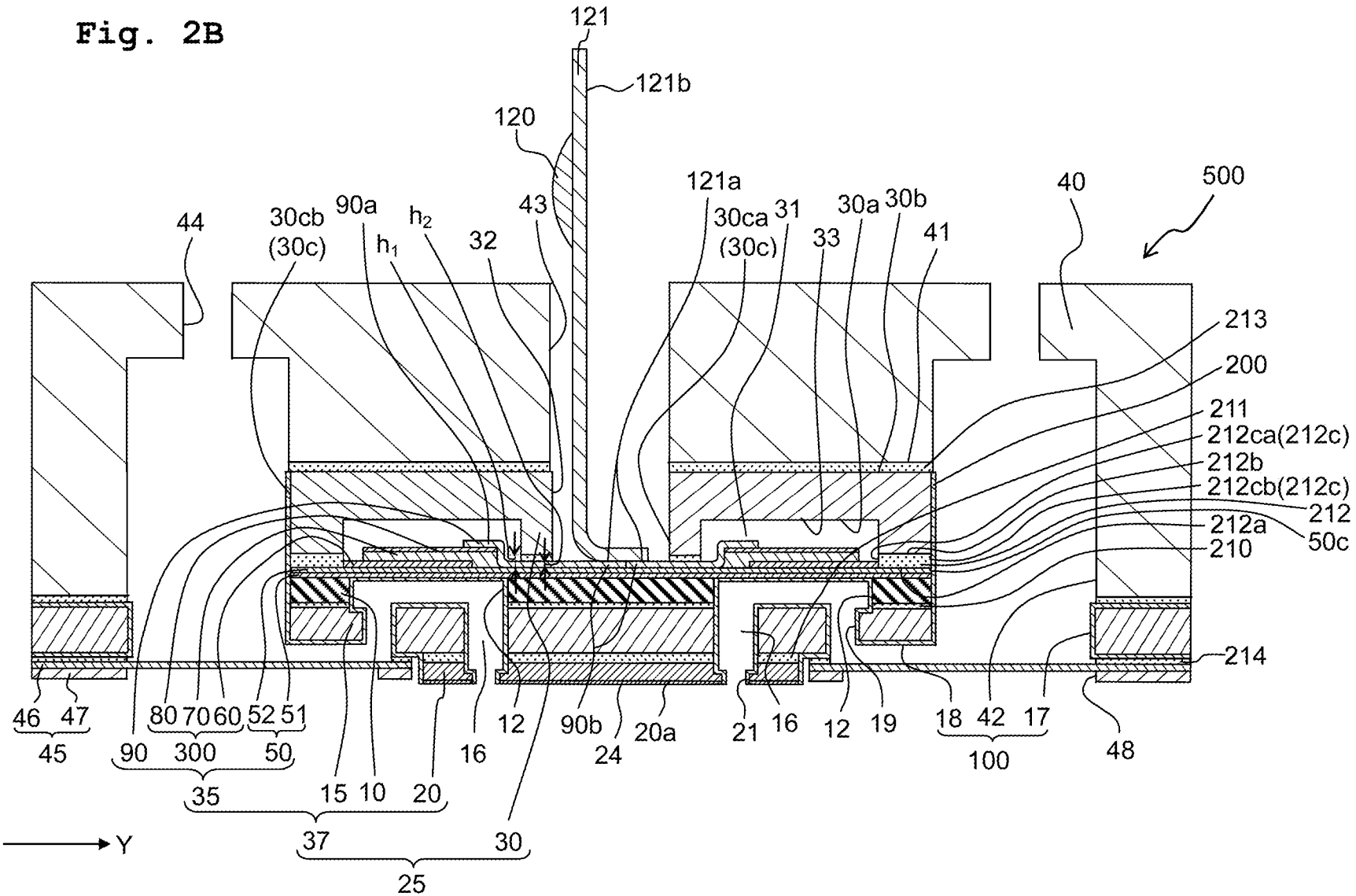

The protective member 30 has a rectangular shape as shown in FIG. 1, and has a lower surface 30*a* which is facing (opposing) the device substrate 35 (the vibration plate 50), an upper surface 30*b* which is on an opposite side of the lower surface 30*a*, and a lateral surface 30*c* which is between the lower surface 30*a* and the upper surface 30*b* as shown in FIG. 2B. A through hole 32 running through the lower surface 30*a* and the upper surface 30*b* (running through a direction of thickness of the protective member 30) is formed in the protective member 30. The through hole 32 may be rectangular-shaped having a long side in the first direction X. Moreover, a recess 33 is formed in the lower surface 30*a* of the protective member 30. The recess 33 and the upper surface of the vibration plate 50 define a protective space 31, and the piezoelectric element 300 is accommodated in the protective space 31. Accordingly, the protective member 30 protects the piezoelectric element 300. Moreover, the first connecting terminal 90*a* of the lead electrode 90 is connected to the piezoelectric element 300 in the protective space 31. The lateral surface 30*c* of the protective member 30 has a surface (first surface) 30*ca* defining the through hole 32 and a surface (second surface) 30*cb* facing the surface 30*ca* with the protective space 31 therebetween. The lead electrode 90 extends in the second direction Y from the inside of the protective space 31 to the through hole 32 which is an outside of the protective space 31, with passing between the vibration plate 50 and the first surface 30*ca* of the protective member 30. Moreover, the second connecting electrode 90*b* of the lead electrode 90 is exposed through the through hole 32. In other words, the first surface 30*ca* of the protective member 30 is positioned between the first connecting electrode 90*c* and the second connecting electrode 90*b* of the lead electrode 90, in the second direction Y. In the through hole 32, the second connecting electrode 90*b* of the lead electrode 90 is electrically connected to the connecting terminal 121*a* of the circuit board 121.

The adhesive layer 212 which adheres the device substrate 35 to the protective member 30 has a lower surface 212*a* contacting the device substrate 35, an upper surface 212*b* contacting the protective member 30, and a lateral surface 212*c* that is between the lower surface 212*a* and the upper surface 212*b*. The lateral surface 212*c* includes a first surface 212*ca* which is exposed to the protective space 31 and a second surface 212*cb* which is positioned at an opposite side of the first surface 212*ca*.

A height $h_1$ of the adhesive layer 212 (in other words, a thickness of an adhesive layer between the vibration plate 50 and the protective member 30) is more than a height (thickness) $h_2$ of the lead electrode 90. This makes it possible to seal the protective space 31 without leaving a gap, and prevent the protective film 200 from being adhered to the piezoelectric element 300 inside the protective space 31 at the time of forming the protective film 200 by the atomic layer deposition as described below. The height $h_1$ of the adhesive layer 212 may be approximately 1.5 μm, and the height $h_2$ of the lead electrode 90 may be approximately 1 μm, for example. The height $h_1$ of the adhesive layer 212 may be less than or equal to the height $h_2$ of the lead electrode 90.

The recess 33 of the protective member 30 may be provided to surround the through hole 32, or may be provided in parallel (side-by-side) in the second direction Y such that the two recesses 33 extending in the first direction X sandwich the through hole 32. A shape of the protective member 30 and a shape and an arrangement of the recess 33 are not limited in particular, provided that it is possible to form the protective space 31 that can accommodate each piezoelectric element 300 without inhibiting a movement of the vibration plate 50.

The stacked body 25 has the flow channel formed by the opening 21 provided in the liquid jetting surface 20*a*, the communicating channel 16, the pressure generating chamber 12, the ink supply channel 19, the second manifold 18 and the first manifold 17. The protective film 200 is formed on an inner wall of the flow channel (in other words, the surface defining the flow channel). The inner wall of the flow channel is formed by the channel substrate 10, the communicating plate 15, the nozzle plate 20 and the protective member 30, and adhesives 210 to 212 bonding the channel substrate 10, the communicating plate 15, the nozzle plate 20 and the protective member 30. The protective film 200 is formed continuously to cover the entire inner wall of the flow channel. Since the protective film 200 covers not only the channel substrate 10, the communicating plate 15, the nozzle plate 20, and the protective member 30 but also the adhesives 210 to 212, it is possible to prevent the adhesives 210 to 212 and surface boundaries (interfaces) between each of the adhesives 210 to 212 and each of the channel substrate 10, the communicating plate 15, the nozzle plate 20, and the protective member 30 from contacting ink directly, thereby suppressing degradation of adhesive strength due to erosion by ink. As seen above, the protective film 200 formed seamlessly on the inner wall of the channel can suppress erosion due to the ink entering from seam and the like, and ensure the protection of the channel substrate 10, the communicating plate 15, the nozzle plate 20, the protective member 30, and the adhesives 210 to 212.

The protective film 200 include at least one type of material selected from a group of tantalum oxide ($TaO_X$), hafnium oxide ($HfO_X$), aluminum oxide ($AlO_X$), and zirconium oxide ($ZrO_X$) as a main constituent. As the abovementioned materials have high ink resistance, the erosion of the stacked body by ink can be suppressed effectively. Here, the ink resistance (liquid resistance) means an etching resistance against an alkaline or an acidic ink (liquid). Specifically, $Ta_2O_5$ ($TaO_X$) with a high film density (about 7 g/cm$^2$) is hard to dissolve in alkali, and $Ta_2O_5$ ($TaO_X$) does not dissolve in an acidic solution except hydrogen fluoride. Therefore, $Ta_2O_5$ ($TaO_X$) is effective as a protective film against a strong alkaline solution and a strong acidic solution. Moreover, since $ZrO_2$ ($ZrO_X$) is insoluble in an alkali and an acidic solution except sulfuric acid and hydrofluoric acid, $ZrO_2$ ($ZrO_X$) is effective as a protective film against a strong alkaline solution and a strong acidic solution. Furthermore, since $HfO_2$ ($HfO_X$) is insoluble in both an alkali and an acid, $HfO_2$ ($HfO_X$) is versatile as a protective film against a strong alkaline solution and a strong acidic solution. $AlO_X$ has a high corrosion resistance against an alkali and an acid. Moreover, it is easy to form a dense $AlO_X$ film. Therefore, $AlO_X$ is effective as a protective film against an alkali, an acid, an organic solvent, and water vapor. Moreover, the protective film 200 may be a film formed as a single layer of a single material or a composite material, or a film in which a plurality of materials is stacked.

The protective film 200 may have a thickness not less than 1 nm and not more than 50 nm, and may have a thickness not less than 10 nm and not more than 30 nm. As it is described below, the protective film 200 is formed by the atomic layer deposition. By using the atomic layer deposition, it is possible to form easily the protective film 200 having a uniform thickness not more than 50 nm which is comparatively thin. Moreover, since the protective film 200 formed by the atomic layer deposition has a high film density, the protective film 200 with a thickness not less than 1 nm can have an adequate ink resistance. When the protective film 200 is thicker than the above-described upper limit, it may take time for the deposition of the protective film 200, which may increase a cost. Moreover, when the protective film 200 is thinner than the above-described lower limit, there is a possibility that a film having uniform thickness and quality throughout is not formed.

Furthermore, using the protective film 200 having such a small thickness can reduce inhibition of displacement of the vibration plate 50 by the protective film 200. Accordingly, in a case in which the protective film 200 of a small thickness is used, the vibration plate 50 can be displaced more largely than in a case in which the protective film 200 of a large thickness is used, even if the piezoelectric element 300 has the same thickness in each case. Moreover, since the protective film 200 having small thickness, the pressure generating chamber 12 can have an adequate volume even when a thickness of the channel substrate 10 is small. Consequently, the protective film 200 having a small thickness can realize thinning of the ink-jet recording head 500 and densification of the nozzle openings 21.

The protective film 200 is formed not only on the inner walls of the opening 21, the communicating channel 16, the pressure generating chamber 12, the ink supply channel 19, the second manifold 18, and the first manifold 17, but also on another surface of the stacked body 25. For example, the second surface 30*cb* of the protective member 30 is covered by the protective film 200. The lateral surface between the upper surface and the lower surface of the channel substrate 10 and the lateral surface 50*c* of the vibration plate 50 are also covered by the protective film 200. Furthermore, the second surface 212*cb* of the adhesive layer 212 bonding the device substrate 35 and the protective member 30 together is also covered by the protective film 200. The protective film 200 is formed continuously and seamlessly to cover all of the abovementioned surfaces and portions.

The second surface 30*cb* of the protective member 30, the lateral surface 50*c* of the vibration plate 50, and the second surface 212*cb* of the adhesive layer 212 connecting the device substrate 35 and the protective member 30, together with the channel substrate 10 and the case member 40 described below, define a third manifold 42. The third manifold 42 is a part of the ink flow channel of the recording head 500. Therefore, since the protective film 200 seamlessly covering the second surface 30*cb* of the protective member 30, the lateral surface 50*c* of the vibration plate 50, and the second surface 212*cb* of the adhesive layer 212 which adheres the device substrate 35 and the protective member 30, it is possible to prevent an ink taken into the third manifold 42 from entering between the device substrate 35 and the protective member 30 and leaking into the protective space 31.

In the present embodiment, as shown in FIG. 2B, the protective film 200 is not formed on the first surface 30*ca* and the upper surface 30*b* of the protective member 30. Moreover, the protective film 200 is not formed on a portion of the lead electrode 90 and a portion of the vibration plate 50, each of which is positioned inside the through hole 32. Accordingly, inside (through) the through hole 32, the second connecting terminal 90*b* of the lead electrode 90 is exposed without being covered by the protective film 200. While the second connecting terminal 90*b* of the lead electrode 90 is connected to the connecting terminal 121*a* of the circuit board 121 as described below, the protective film 200 does not exist between the second connecting terminal 90*b* of the lead electrode 90 and the connecting terminal 121*a* of the circuit board 121. Therefore, it is possible to electrically connect the lead electrode 90 and the circuit board 121. Moreover, the protective film 200 is not formed on the upper surface 30*b* and the first surface 30*ca* of the protective member 300, but is formed on the second surface 30*cb* of the protective member 30. Since the second surface 30*cb* being covered by the protective film 200, it is possible to prevent the ink taken in the third manifold 42 described below from directly contacting the protective member 30, thereby preventing the protective member 30 from being eroded by ink.

(2) Circuit Board 121

The circuit board 121 may be a flexible substrate provided with a drive circuit 120, such as COF (Chip On Film). The connecting terminal 121*a* is provided to one end of the circuit board 121, and the connecting terminal 121*a* is electrically connected to the second connecting terminal 90*b* of the lead electrode 90. The other end of the circuit board 121 is provided with another connecting terminal 121*b* which is different from the connecting terminal 121*a*. The connecting terminal 121*b* may be used to form an electrical connection with an electronic member such as a member on which a circuit that controls a jetting operation of the recording head 500 and the like and/or an electronic component such as resistance are(is) mounted. The drive circuit 120 need not be provided to the circuit board 121, which means that the circuit board 121 is not limited to COF but may be an FFC (Flexible Flat Cable) or an FPC (Flexible Printed Circuit) and the like. The abovementioned protective film 200 is not formed on a surface of the drive circuit 120 and the circuit board 121.

(3) Case Member 40.

The case member 40 is fixed to the stacked body 25 via an adhesive 213. The case member 40 has a substantially same shape as a shape of the communicating plate 15 in a plan view. The case member 40 is fixed to the protective member 30 via the adhesive 213, and is also fixed to the abovementioned communicating plate 15 via the adhesive 213. The case member 40 has a recess 41 having a depth to accommodate the channel substrate 10 and the protective member 30, on a surface facing (opposite to) the stacked body 25. The recess 41 has an area wider than a surface of the protective member 30 joined to the device substrate 35. The case member 40 and the stacked body 25 define the third manifold 42 adjacent to the recess 41. The third manifold 42 communicates with the first manifold 17. Moreover, a manifold 100 is formed by the first manifold 17 and the second manifold 18 provided to the communicating plate 15, and the third manifold 42 defined by the case member 40 and the stacked body 25.

It is possible to use a resin or a metal, etc. as a material of the case member 40. By using a molding of a resin as the case member 40, it is possible to mass-produce the recording head at a low cost.

The case member 40 is provided with an introducing channel 44 for communicating with the manifold 100 and supplying ink to each manifold 100. Moreover, the case member 40 is provided with a connecting port 43 which communicates with the through hole 32 of the protective member 30 and into which the circuit board 121 is inserted.

(4) Compliance Substrate 45

The compliance substrate 45 is provided on a surface, of the communicating plate 15, on a side of liquid jetting surface 20*a* of the first manifold 17 and the second manifold 18. The compliance substrate 45 seals openings of the first manifold 17 and the second manifold 18 on the liquid jetting surface 20*a* side. In other words, the compliance substrate 45 defines a portion of the manifold 100.

The compliance substrate 45 includes a sealing film 46 and a fixed substrate 47. The sealing film 46 is made of a thin film having flexibility (a thin film of thickness not more than 20 μm formed of a material such as polyphenylene sulfide (PPS) or stainless steel (SUS)). The fixed substrate 47 is formed of a hard material such as a metal such as stainless steel (SUS). The fixed substrate 47 is completely removed in a direction of thickness in an area facing (opposite to) the manifold 100, thereby forming an opening portion 48. Accordingly, since the manifold 100, on the liquid jetting surface 20*a* side, is sealed by the sealing film 46 having flexibility, the sealing film 46 can absorb a pressure fluctuation of the manifold 100 during the time when the recording head 500 is operated.

The basic arrangement of the ink-jet recording head has been described above.

However, the ink-discharge head is not limited to the ink-discharge head described above. Modified embodiments will be described below, and the modified embodiments and the embodiment may be combined appropriately.

Figure 2C:
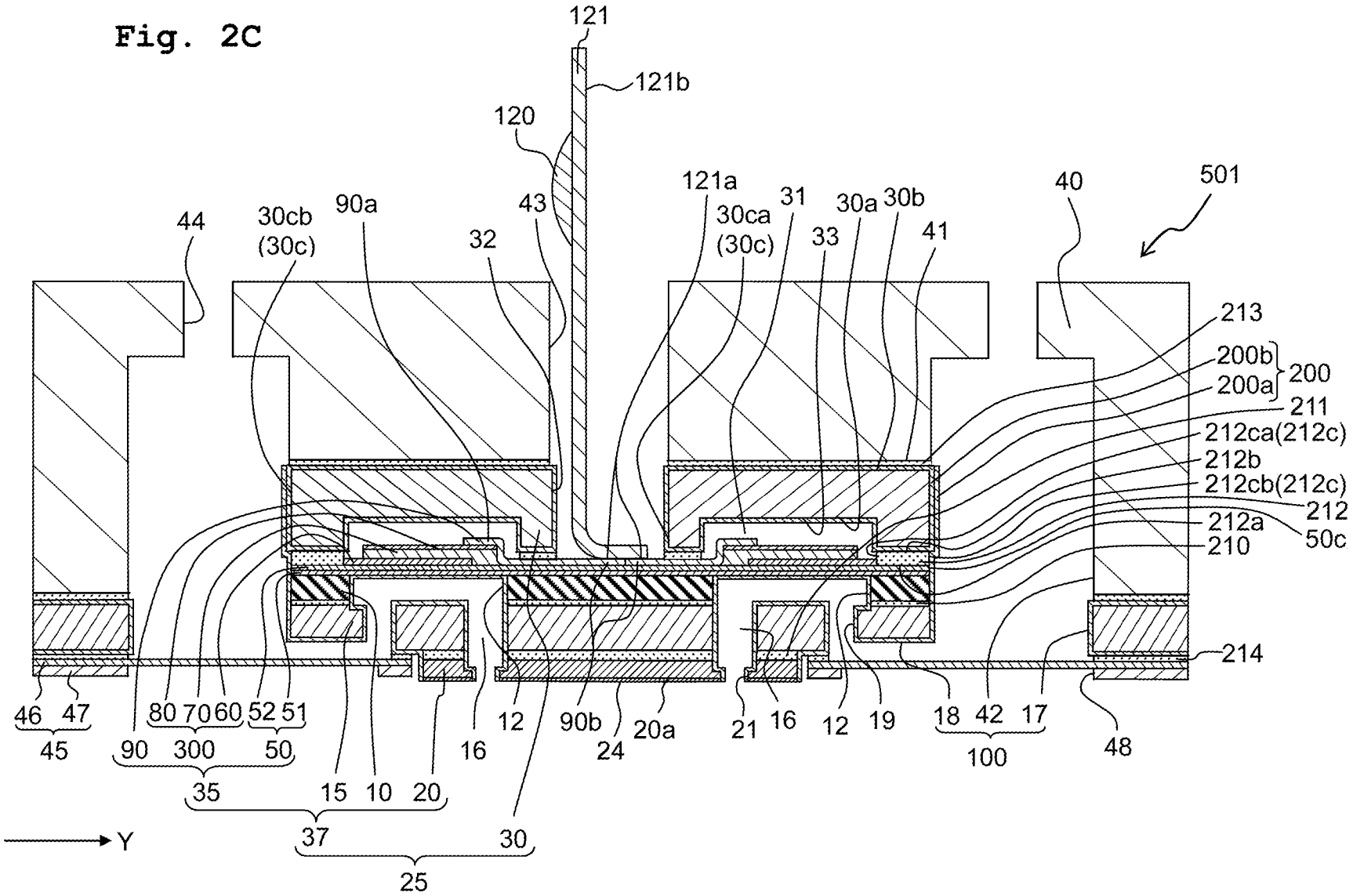
FIG. 2C is a schematic cross-sectional view of a recording head according to a first modified embodiment.

A recording head 501 according to a first modified embodiment shown in FIG. 2C has a protective film 200 which includes a first protective film 200*a* and a second protective film 200*b*. The first protective film 200*a* is not formed on the upper surface 30*b* and the first surface 30*ca* of the protective member 30, but is formed on the second surface 30*cb* of the protective member 30. The second protective film 200*b* is formed on the surface of the protective member 30 (in other words, on the lower surface 30*a*, the upper surface 30*b*, the first surface 30*ca*, and the second surface 30*cb* of the protective member 30). In the first modified embodiment, the protective member 30 is covered by the second protective film 200*b*, which assuredly suppress the erosion of the protective member 30 by ink. For instance, since the first surface 30*ca* of the protective member 30 being covered by the second protective film 200*b*, the protective member 30 can be prevented from being corroded by the ink even when the ink enters into the through hole 32 during manufacturing (assembling) of the recording head 500. Moreover, since the upper surface 30*b* of the protective member 30 being covered by the second protective film 200*b*, corrosion of the protective member 30 by the ink and leaking of the ink into the through hole 32 can be prevented even when the ink enters between the protective member 30 and the case member 40. A portion of the protective film 200 positioned on the first surface 30*ca* includes only the second protective film 200*b*, and a portion of the protective film 200 positioned on the second surface 30*cb* includes the first protective film 200*a* and the second protective film 200*b*. Therefore, the portion of the protective film 200 positioned on the first surface 30*ca* has a thickness smaller than the portion of the protective film 200 positioned on the second surface 30*cb*. Specifically, a thickness of the portion of the protective film 200 positioned on the second surface 30*cb* of the protective member 30 may be twice or more than twice the thickness of the portion of the protective film 200 positioned on the first surface 30*ca* of the protective member 30. Since the second surface 30*cb* of the protective member 30 being a cutting surface cut by dicing as described below, a roughness thereof is greater than a roughness of the first surface 30*ca*. It is possible to prevent assuredly the erosion of the protective member 30 by the ink by making the thickness of the protective film 200 on the second surface 30*cb* of the protective member 30 twice or more than the thickness of the protective film 200 on the first surface 30*ca* of the protective member 30. 'The portion of the protective film 200 positioned on the first surface 30*ca* has a thickness smaller than the thickness of the portion of the protective film 200 positioned on the second surface 30*cb*' does not include a case in which the protective film 200 on the first surface 30*ca* is thinner than the protective film 200 on the second surface 30*cb* due to an error, specifically a case in which the thickness of the protective film 200 on the first surface 30*ca* is within a range of 90% to 100% of the thickness of the protective film 200 on the second surface 30*cb*.

Figure 2D:
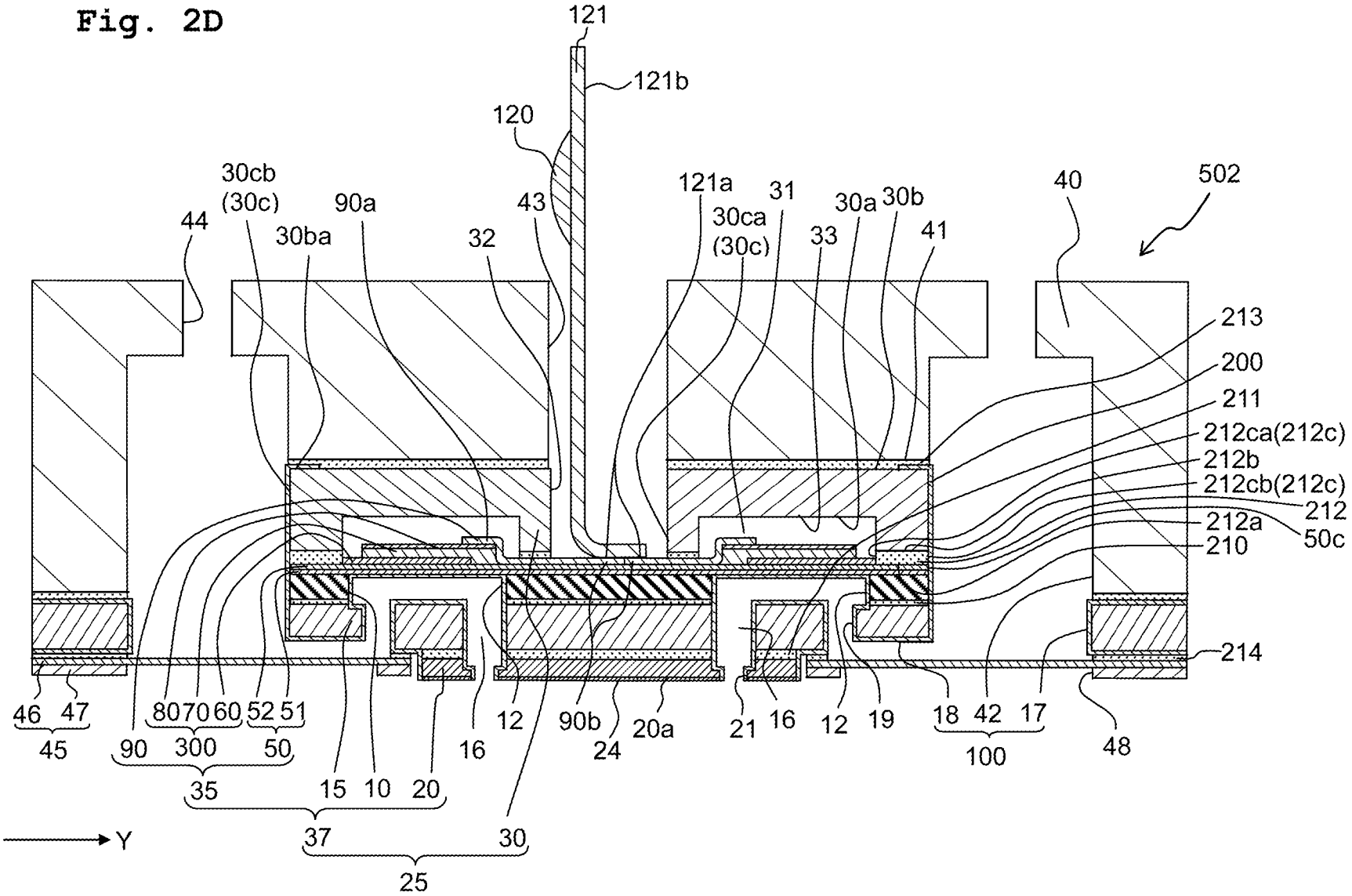
FIG. 2D is a schematic cross-sectional view of a recording head according to a second modified embodiment.

Moreover, in a recording head 502 according to a second modified embodiment shown in FIG. 2D, the protective film 200 is formed on the second surface 30*cb* of the protective member 30, and furthermore, the protective film 200 is also formed on an outer edge portion 30*ba* on the upper surface 30*b* of the protective member 30 (in other words, a belt-shaped area on the upper surface 30*b* of the protective member 30 including an intersection line between the upper surface 30*b* and the second surface 30*cb*, and extending along the intersection line). The entire outer edge portion 30*ba* on the upper surface 30*b* of the protective member 30 is not required to be covered by the protective film 200, and a portion of the outer edge portion 30*ba* on the upper surface 30*b* of the protective member 30, which extends in the first direction X (a direction of depth of a paper surface of FIG. 2D), may be covered by the protective film 200. The protective film 200 is not formed on the first surface 30*ca* of the protective member 30. In the recording head 502 according to the second modified embodiment, even in a case in which the portion of the outer edge portion 30*ba* on the upper surface 30*b* of the protective member 30 which extends in the first direction X is not covered by the adhesive 213 (in other words, in a case in which the adhesive 213 is not flush with the second surface 30*cb* of the protective member 30 and is not protruded toward the third manifold 42 from the second surface 30*cb* of the protective member 30), the protective film 200 on the outer edge portion 30*ba* prevents the ink taken into the manifold 42 from directly contacting the protective member 30, which suppress the erosion of the protective member 30 by the ink.

In any of the embodiment shown in FIG. 2B and the modified embodiments shown in FIG. 2C and FIG. 2D, the thickness of the protective film 200 on the first surface 30*ca* of the protective member 30 is equal to or more than 0, and is smaller than the thickness of the protective film 200 on the surface of the second surface 30*cb* of the protective member 30.

Figure 2E:
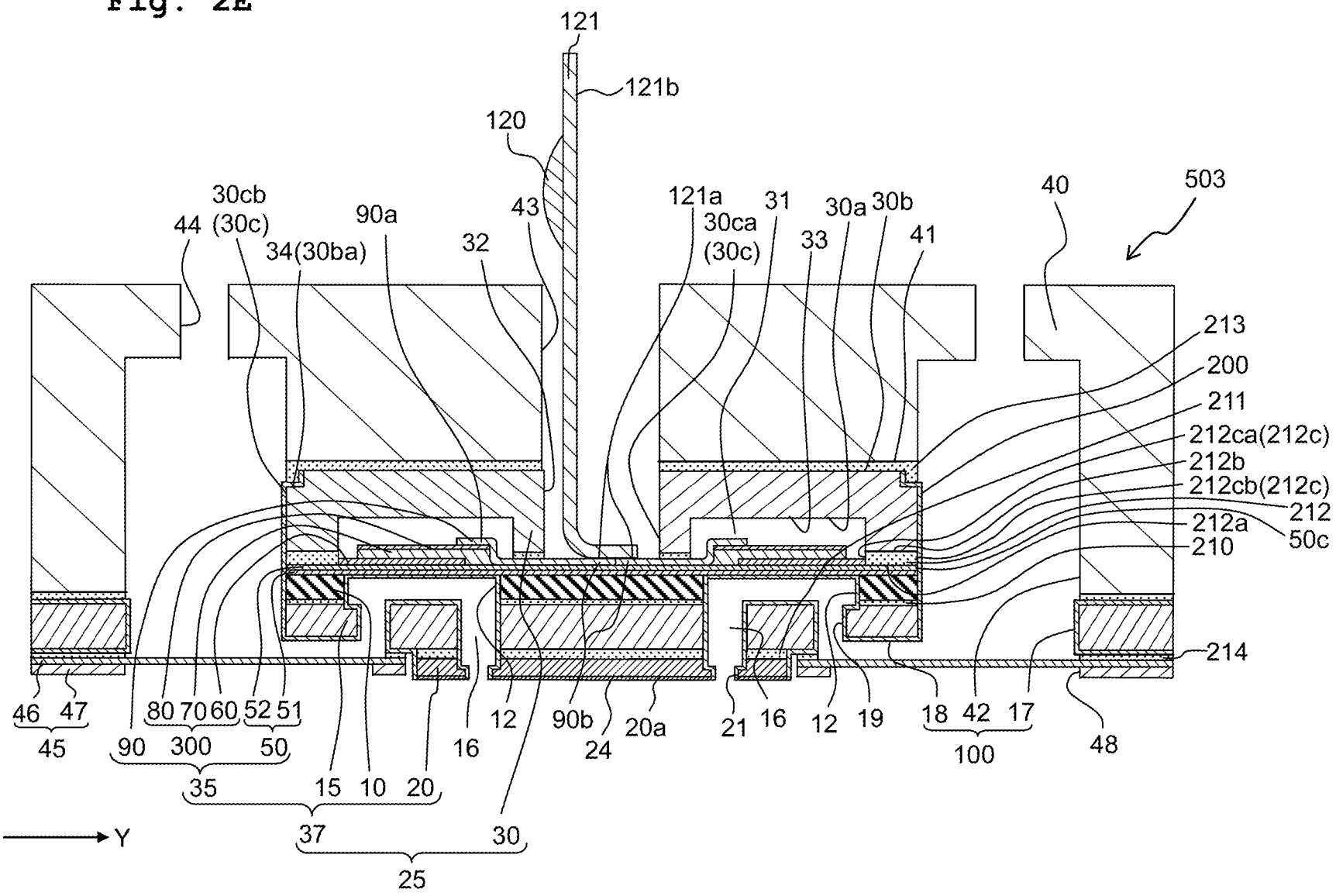
FIG. 2E is a schematic cross-sectional view of a recording head according to a third modified embodiment.

Moreover, in a recording head 503 according to a third modified embodiment shown in FIG. 2E, a stepped portion 34 is formed on the outer edge portion 30*ba* on the upper surface 30*b* of the protective member 30. The stepped portion 34 need not be formed on the entire outer edge portion 30*ba* on the upper surface 30*b* of the protective member 30, and may be formed on a portion of the outer edge portion 30*ba* on the upper surface 30*b* of the protective member 30, the portion extending along the first direction X. The stepped portion 34 and the second surface 30*cb* of the protective member 30 are covered by the protective film 200. The protective film 200 is not formed on the first surface 30*ca* of the protective member 30 and an upper surface 30*b* of the protective member 30 excluding the stepped portion 34. A portion of the protective film 200 covering the stepped portion 34 is joined to the case member 40 via the adhesive (adhesive layer) 213. Accordingly, in a case in which, the adhesive 213 bonding the protective member 30 and the case member 40 does not coat the entire stepped portion 34 (in other words, even in a case in which, the adhesive is not flush with the second surface 30*cb* of the protective member 30 and is not protruded toward the third manifold 42 from the second surface 30*cb* of the protective member 30) due to variations in the amount and the position of the adhesive 213 application, the upper surface 30*b* of the protective member 30 which is not covered by the protective film 200 is not exposed to the third manifold 42. Consequently, it is possible to assuredly prevent an ink taken into the third manifold 42 from making a direct contact with the protective member 30, thereby suppressing the erosion of the protective member 30 by the ink. A corner of the stepped portion 34 may be rounded. Moreover, instead of providing the stepped portion 34, a chamfered or filleted portion may be provided by chamfering or filleting the outer edge portion 30*ba* of the protective member 30. Chamfering or filleting may be carried out by providing an inclined portion to the outer edge portion 30*ba* or by rounding the outer edge portion 30*ba*.

<Operation of Liquid Discharge Head>

For the ink-jet recording head 500 which is an example of the liquid discharge head, an operation for jetting an ink is described below. Firstly, the ink is taken into the manifold 100 via an introducing channel 44 from an ink storage means such as a cartridge, and an interior of a flow channel from the manifold 100 up to the nozzle opening 21 is filled with the ink. In other words, the opening 21, the communicating channel 16, the pressure generating chamber 12, the ink supply channel 19, the second manifold 18, the first manifold 17, the third manifold 42, and the introducing channel 44 form the ink flow channel of the recording head 500. Thereafter, a voltage is applied to the piezoelectric element 300 corresponding to the pressure generating chamber 12 in accordance with a signal from the drive circuit 120, thereby bending and deforming the piezoelectric element 300 as well as the elastic film 51 and the insulator film 52. Accordingly, a pressure inside the pressure generating chamber 12 rises up and ink droplets are jetted from the nozzle opening 21.

<Method of Manufacturing Liquid Discharge Head>

Figure 3:
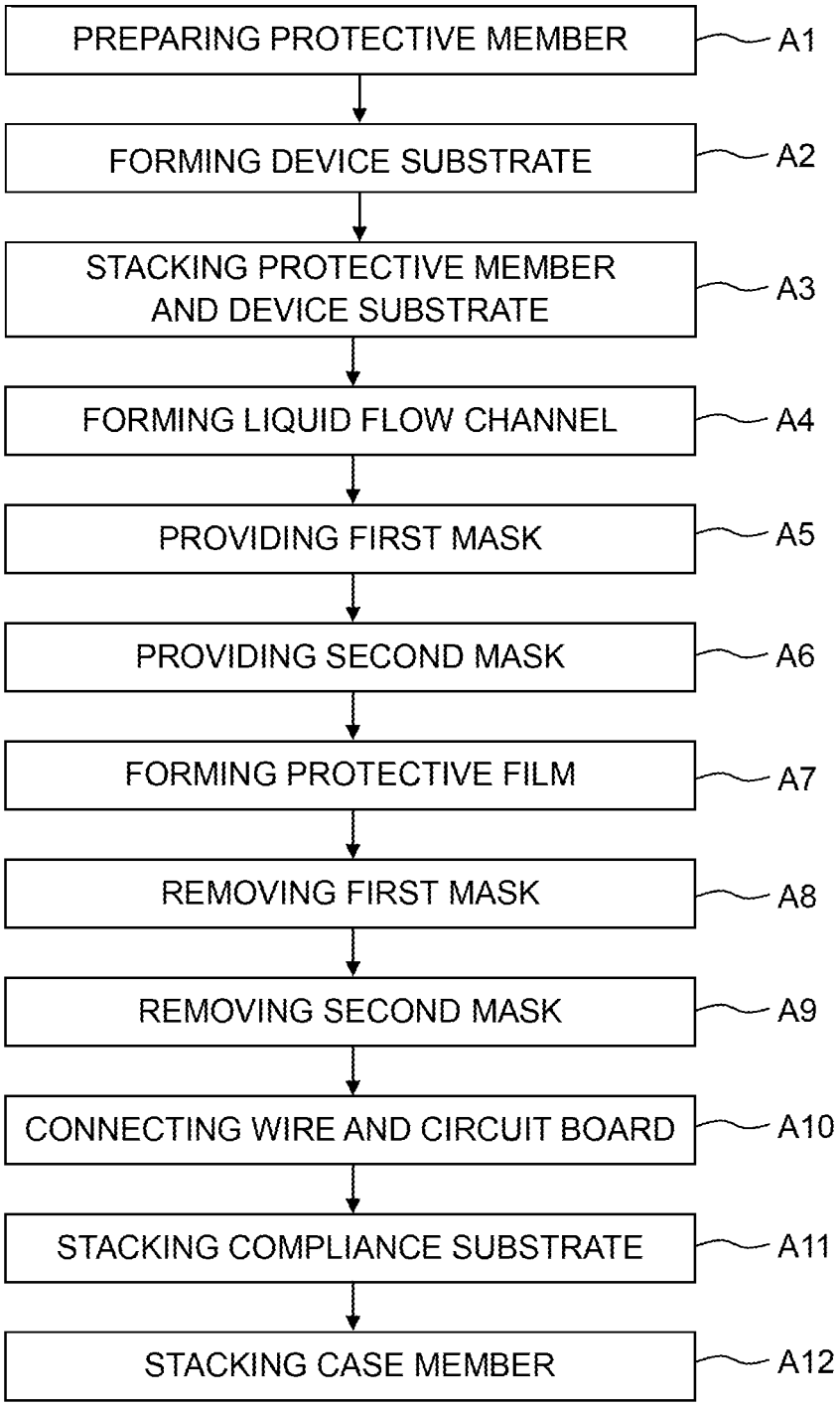
FIG. 3 is a flowchart showing a method of manufacturing a liquid discharge head according to the embodiment.

A method of manufacturing liquid discharge head, as shown in FIG. 3, includes, preparing a protective member (A1), forming a device substrate having a piezoelectric element and a trace (A2), stacking the device substrate and the protective member (A3), forming liquid flow channel to obtain a structure having the piezoelectric element, the trace, and the liquid flow channel (A4), providing a first mask on the protective member (A5), providing a second mask on a first surface (liquid jetting surface) of the structure in which an opening for jetting a liquid is formed (A6), forming a protective film by the atomic layer deposition on a surface which defines the liquid flow channel (A7), removing the first mask (A8), removing the second mask (A9), connecting a connecting terminal of a circuit substrate to a connecting terminal of the trace (A10), stacking a compliance substrate (A11), and staking a case member (A12). Each process will be described below while referring to FIG. 4 to FIG. 15. FIG. 4 to FIG. 15 are cross-sectional views conceptually showing each process of the method of manufacturing the ink-jet recording heads shown in FIG. 2A and FIG. 2B, which are examples of the liquid discharge head.

(1) Preparing Protective Member (A1)

Figure 4:
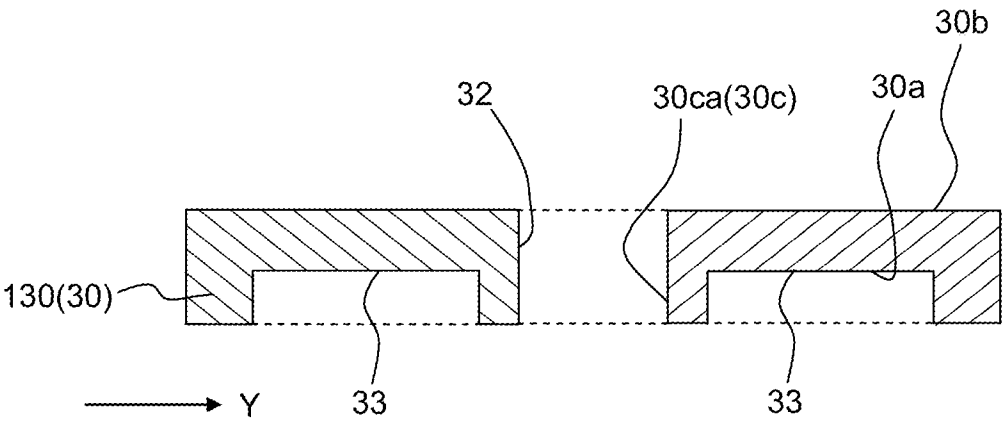
FIG. 4 is a view conceptually showing a process of preparing a protective member.

As shown in FIG. 4, a protective member wafer 130, in which a series of protective members 30 is formed, is prepared. The protective member wafer 130 has the recess 33 and the through hole 32 formed therein for each protective member 30. The protective member wafer 130 may be a silicon wafer. A method for forming the recess 33 and the through hole 32 in the protective member wafer 130 is not limited in particular. For example, it is possible to form the recess 33 and the through hole 32 with high accuracy by an anisotropic etching in which an alkaline solution such as KOH (potassium hydroxide) is used.

(2) Forming Device Substrate (A2)

Figure 5A:
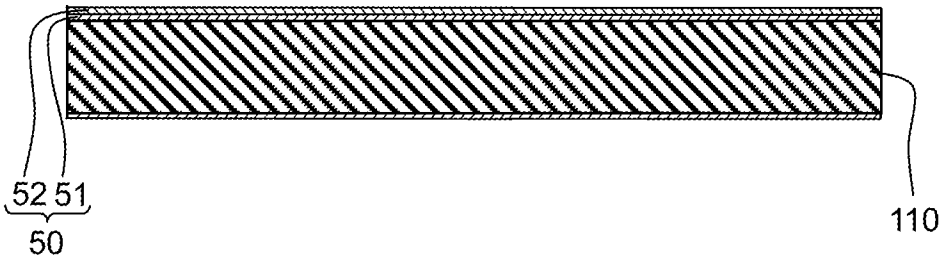
FIG. 5A is a view conceptually showing a process of forming a device substrate.

A channel substrate wafer 110 is prepared. The channel substrate wafer 110 may be a silicon wafer. As shown in FIG. 5A, the vibration plate 50 is formed on one surface of the channel substrate wafer 110. In a case in which the channel substrate wafer 110 is a silicon wafer, it is possible to form the elastic film 51 made of silicon dioxide by thermally oxidizing the channel substrate wafer 110. Furthermore, it is possible to form the insulator film 52 made of zirconium oxide by thermal oxidation after forming a film of zirconium by sputtering. Accordingly, it is possible to form the vibration plate 50 in which the elastic film 51 and the insulator film 52 are stacked.

A material of the vibration plate 50 is not limited to zirconium dioxide and zirconium oxide, but may be a material such as silicon nitride ($Si_3N_4$), titanium oxide ($TiO_2$), aluminum oxide ($Al_2O_3$), hafnium oxide ($HfO_2$), magnesium oxide (MgO), or lanthanum aluminate ($LaAlO_3$). Moreover, a method for forming the elastic film 51 is not limited to a thermal oxidation, but may be a method such as a sputtering method, a CVD (chemical vapor deposition) method, a vapor deposition method, or a spin coating method or a combination thereof.

Figure 5B:
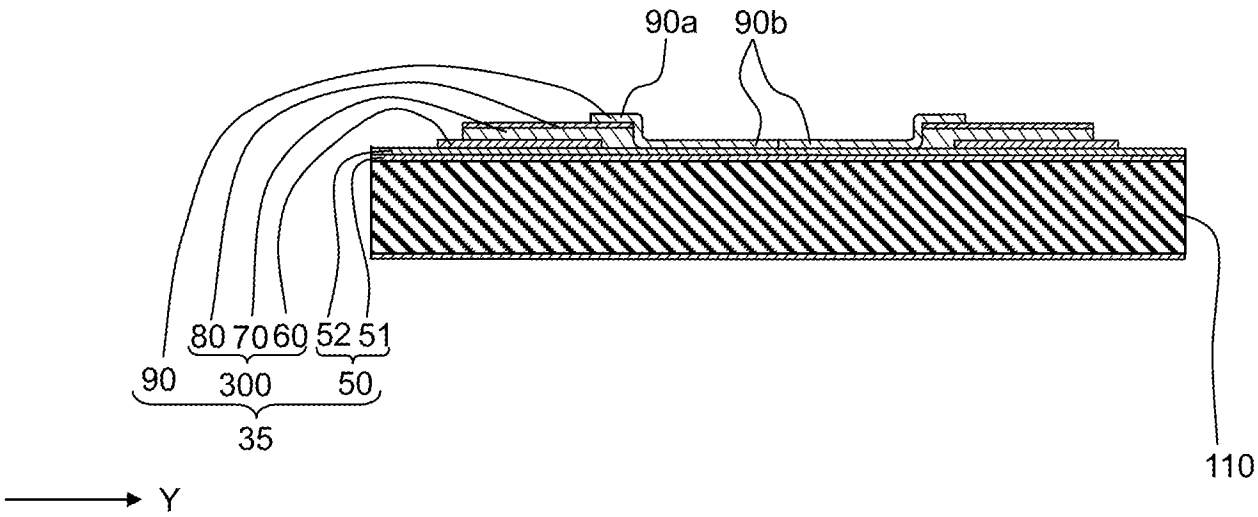
FIG. 5B is a view conceptually showing a process of forming the device substrate.

Next, as shown in FIG. 5B, the piezoelectric element 300 and the lead electrode 90 are formed on the vibration plate 50. It is possible to form each layer of the piezoelectric element 300 (in other words, the first electrode 60, the piezoelectric layer 70, and the second electrode 80) and the lead electrode 90 by a film forming and a lithography method for each pressure generating chamber 12. Moreover, it is possible to form the piezoelectric layer by a sol-gel method, a MOD (metal organic deposition) method, or a PVD (physical vapor deposition) method such as a sputtering method or a laser ablation method. In such manner, the device substrate 35 which includes the vibration plate 50, the piezoelectric element 300 (the first electrode 60, the piezoelectric layer 70, and the second electrode 80), and the lead electrode 90 is formed on the channel substrate wafer 110.

(3) Stacking Protective Member and Device Substrate (A3)

Figure 6:
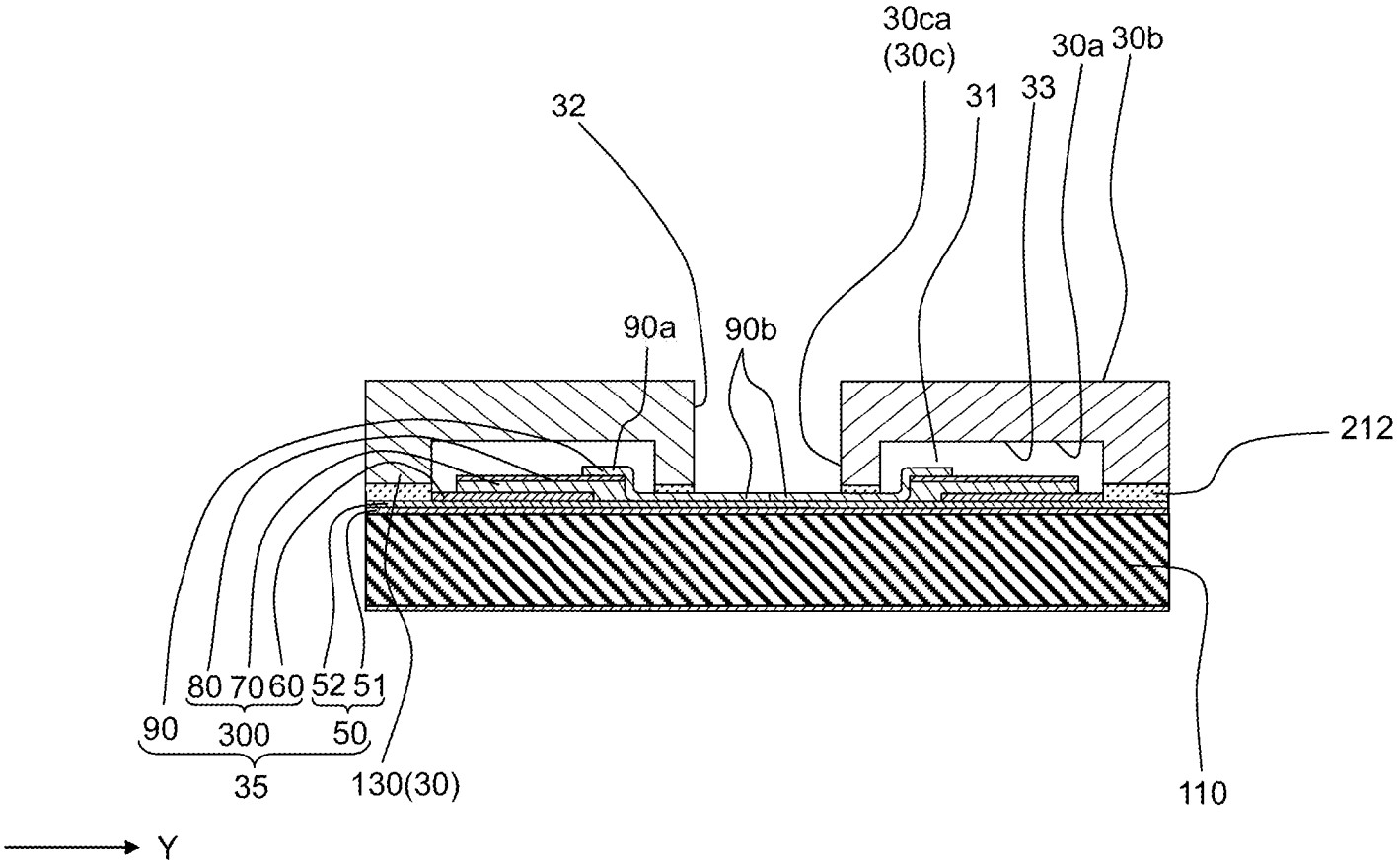
FIG. 6 is a view conceptually showing a process of stacking the protective member.

As shown in FIG. 6, the protective member wafer 130 is joined to a piezoelectric element 300 side of the device substrate 35 via the adhesive 211. The protective member wafer 130 and the channel substrate wafer 110 are joined such that the piezoelectric element 300 and the first connecting terminal 90*a* of the lead electrode 90 connected to the piezoelectric element 300 are accommodated inside the protective space 31 defined by the recess 33 of the protective member wafer 130, and the lead electrode 90 extends from the inside of the protective space 31 to the through hole 32 to expose the second connecting terminal 90*b* of the lead electrode 90 in (through) the through hole 32.

(4) Forming Flow Channel (A4)

Figure 7A:
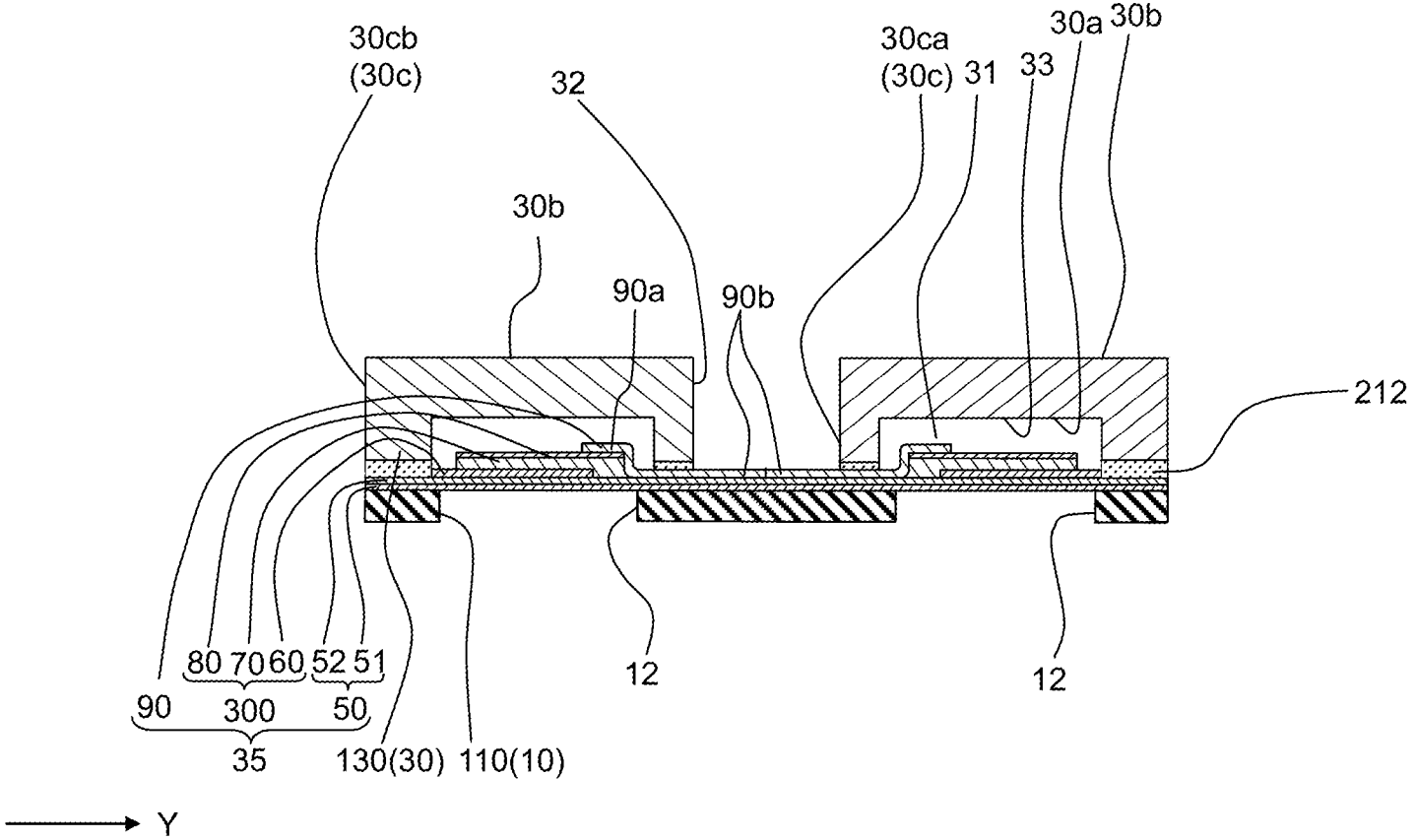
FIG. 7A is a view conceptually showing a process of forming a liquid flow channel.

As shown in FIG. 7A, after the channel substrate wafer 110 is ground to a predetermined thickness, the pressure generating chamber 12 corresponding to each piezoelectric element 300 is formed by anisotropic etching on the channel substrate water 110 via a mask not shown in the figure, from a side of a surface opposite to the protective member wafer 130. Furthermore, unnecessary portions of the channel substrate wafer 110 and the protective member wafer 130 are removed, and the channel substrate wafer 110 and the protective member wafer 130 are divided (split) into one chip size as shown in FIG. 1. Accordingly, the channel substrate 10 is obtained from the channel substrate wafer 110, and the protective member 30 is obtained from the protective member wafer 130. Division (Splitting) into chips may be carried out by dicing, and in this case, the second surface 30*cb* of the protective member 30 is a cutting surface which is cut by dicing.

Figure 7B:
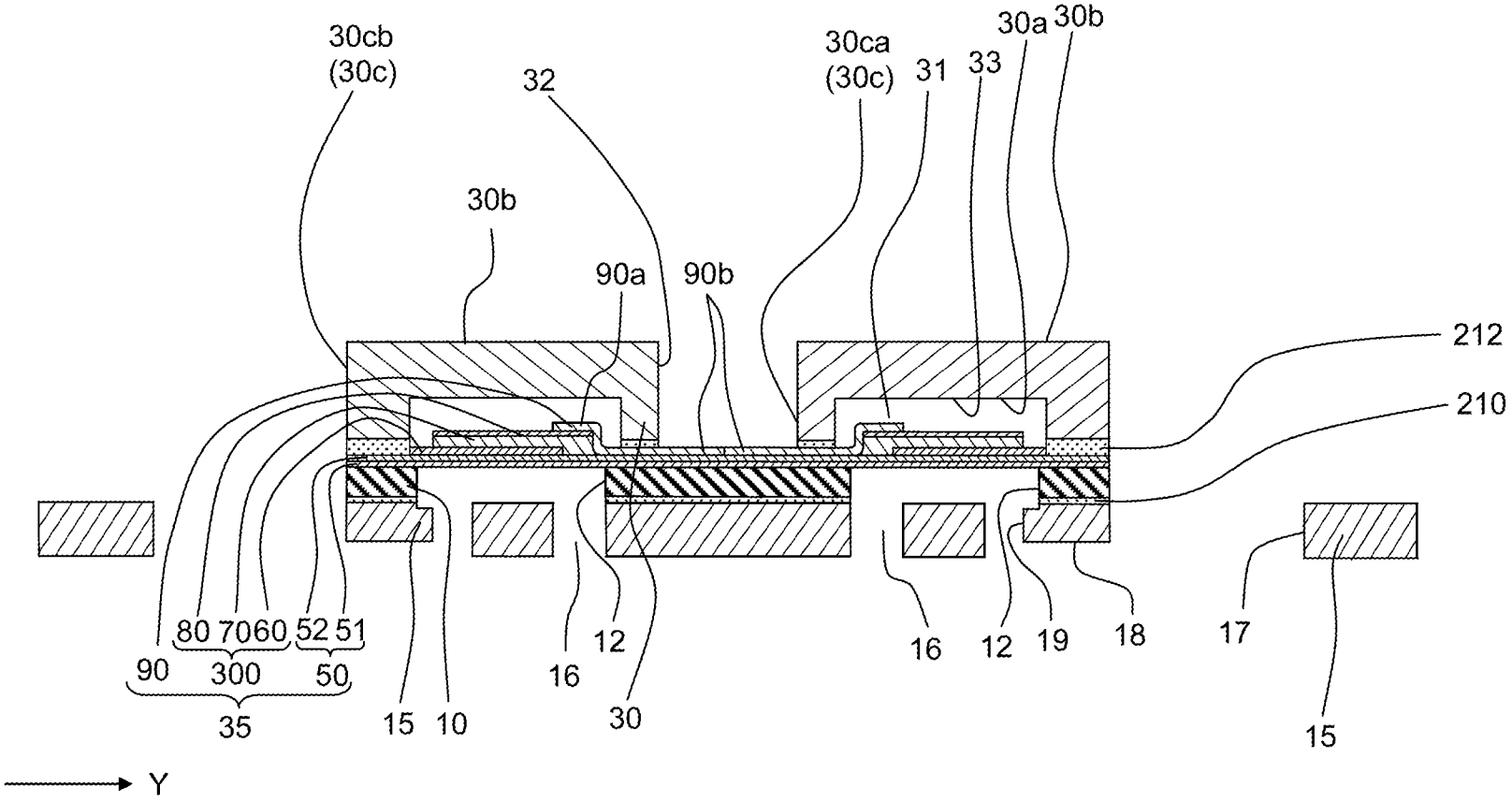
FIG. 7B is a view conceptually showing a process of forming the liquid flow channel.

Next, as shown in FIG. 7B, the communicating plate 15 is joined to the channel substrate 10 via the adhesive 210. The communicating plate 15 is a plate in which the nozzle communicating channel 16, the first manifold 17, the second manifold 18, and the ink supply channel 19 are formed in advance.

Figure 7C:
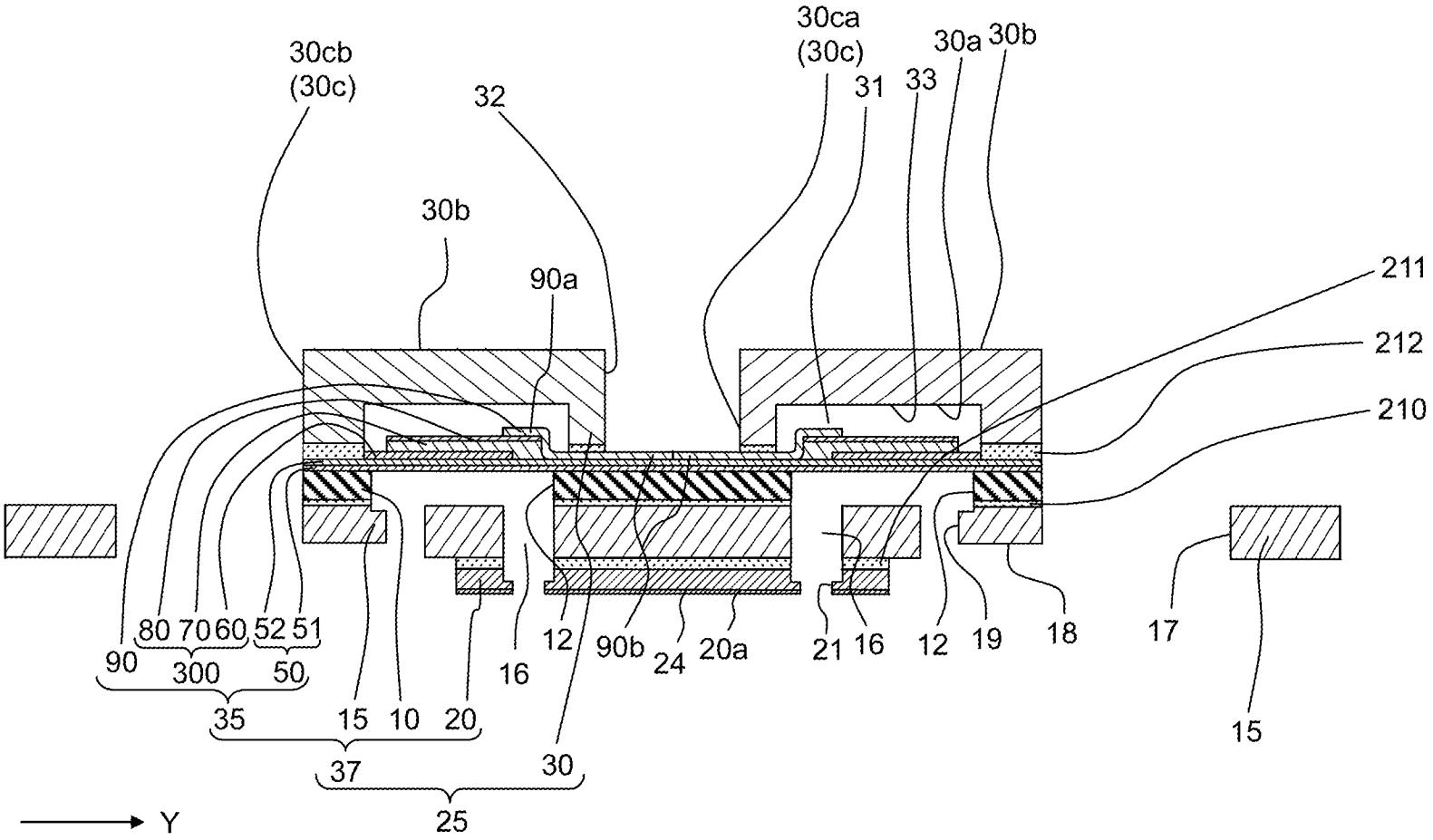
FIG. 7C is a view conceptually showing a process of forming the liquid flow channel.

Next, as shown in FIG. 7C, the nozzle plate 20 is joined to the communicating plate 15 via the adhesive 211. The nozzle opening 21 is formed in advance in the nozzle plate 20. The nozzle opening 21 communicates with the pressure generating chamber 12 via the nozzle communicating channel 16. Accordingly, the structure 37 which includes the channel substrate 10, the communicating plate 15, the nozzle plate 20, and the device substrate 35 is obtained. Moreover, the stacked body 25 including the structure 37 and the protective member 30 stacked on the structure 37 is obtained.

The liquid repellent film 24 may be formed in advance on the liquid jetting surface 20*a* of the nozzle plate 20. The liquid repellent film 24 can be formed by forming a molecular film of a metal alkoxide having a liquid repellent property, and thereafter carrying out a treatment such as drying or annealing.

Thus, the stacked body 25 which includes the structure 37 having the piezoelectric element 300, the lead electrode 90, and the liquid flow channel, and the protective member 30 which protects the piezoelectric element 30 and is stacked on the structure 37, are formed.

(5) Providing First Mask (A5)

Figure 8:
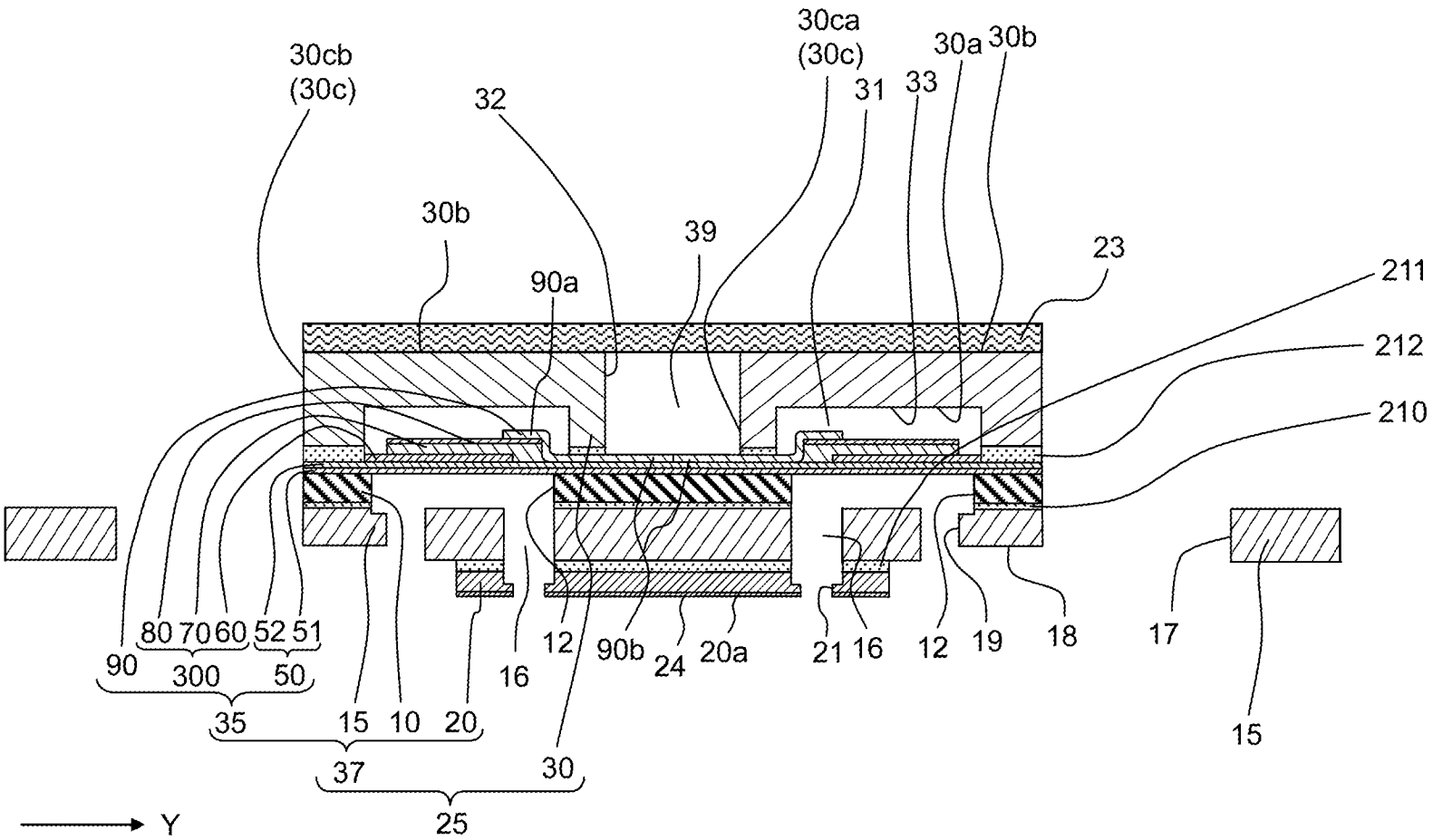
FIG. 8 is a view conceptually showing a process of forming a first mask.

As shown in FIG. 8, a first mask 23 is provided on the upper surface 30*b* of the protective member 30 to cover the through hole 32. Accordingly, a first space 39 which is sealed by the first surface 30*ca* defining the through hole 32 of the protective member 30, the device substrate 35, and the first mask 23 is defined. The first mask 23 may be a silicone resin film, a dry film resist, a heat release film, an ultraviolet release film, or a plate member. The silicone resin film is preferable as it has a high heat resistance. Since the heat release film can be peeled by heating continuously subsequent to the formation of the protective film 200 by the atomic layer deposition that is described below, the heat release film is preferable from a point that the number of man-hours required for the peeling is less. Moreover, the first mask 23 may have an adhesive layer of a thickness in a range of 15 μm to 50 μm. In a case that the thickness of the adhesive layer is within the abovementioned range, it is possible to seal the first space 39 without leaving a gap, thereby making it possible to prevent effectively the protective film 200 from being formed in the first space 39 in a process of forming the protective film 200 that is described below. The adhesive layer of the first mask 23 may have elasticity not more than $5\times10^6$ N/m$^2$. In this case, since the first mask 23 is adhered to the protective member wafer 130 without leaving a gap, thereby making it possible to seal the first space 39 assuredly, it is possible to prevent effectively the protective film 200 from being formed inside the first space 39 in the process of forming the protective film 200 that is described below.

(6) Providing Second Mask (A6)

Figure 9:
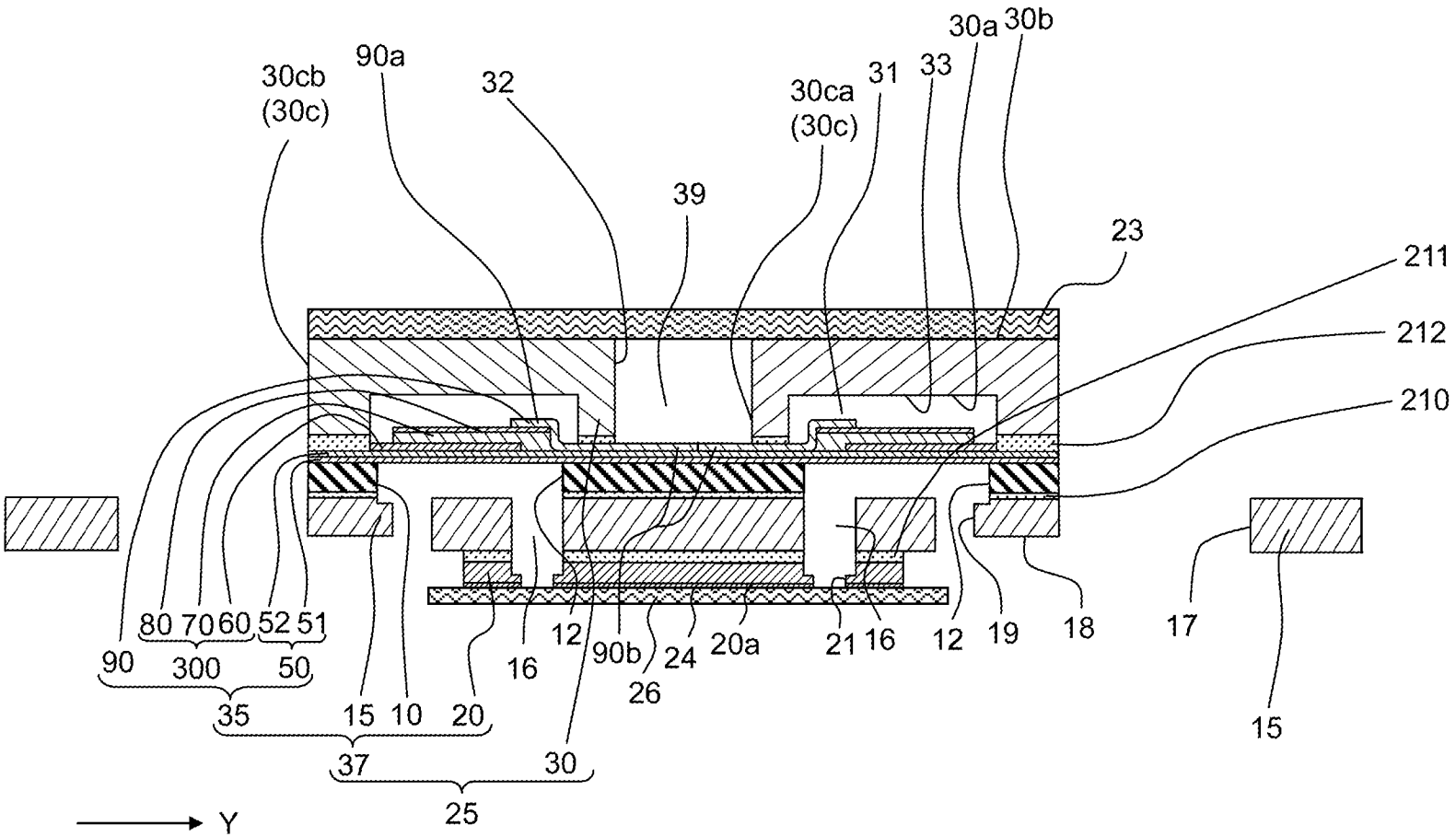
FIG. 9 is a view conceptually showing a process of forming a second mask.

As shown in FIG. 9, a second mask 26 is provided on the liquid jetting surface 20*a* of the nozzle plate 20, or in other words, on the liquid jetting surface 20*a* of the structure 37 or the stacked body 25. The second mask 26 may be a silicone resin film, a heat release film, or an ultraviolet release film. The silicone resin film is preferable as it has a high heat resistance. Since the heat release film can be peeled off by heating continuously subsequent to the formation of the protective film 200 by the atomic layer deposition that is described below, the heat release film is preferable from a point that the number of man-hours required for the peeling is less. Moreover, the second mask 26 may have an adhesive layer of a thickness in a range of 15 μm to 50 μm. In a case that the thickness of the adhesive layer being within the abovementioned range, it is possible to mask the liquid jetting surface 20*a* without leaving a gap, thereby making it possible to prevent effectively the protective film 200 from adhering to the liquid jetting surface 20*a* and the liquid repellent film 24 from being damaged in the process of forming the protective film 200 that is described below. The second mask 26 is not required to have an opening corresponding to the nozzle opening 21, and the nozzle opening 21 may be covered by the second mask 26.

(7) Forming Protective Film (A7)

Figure 10:
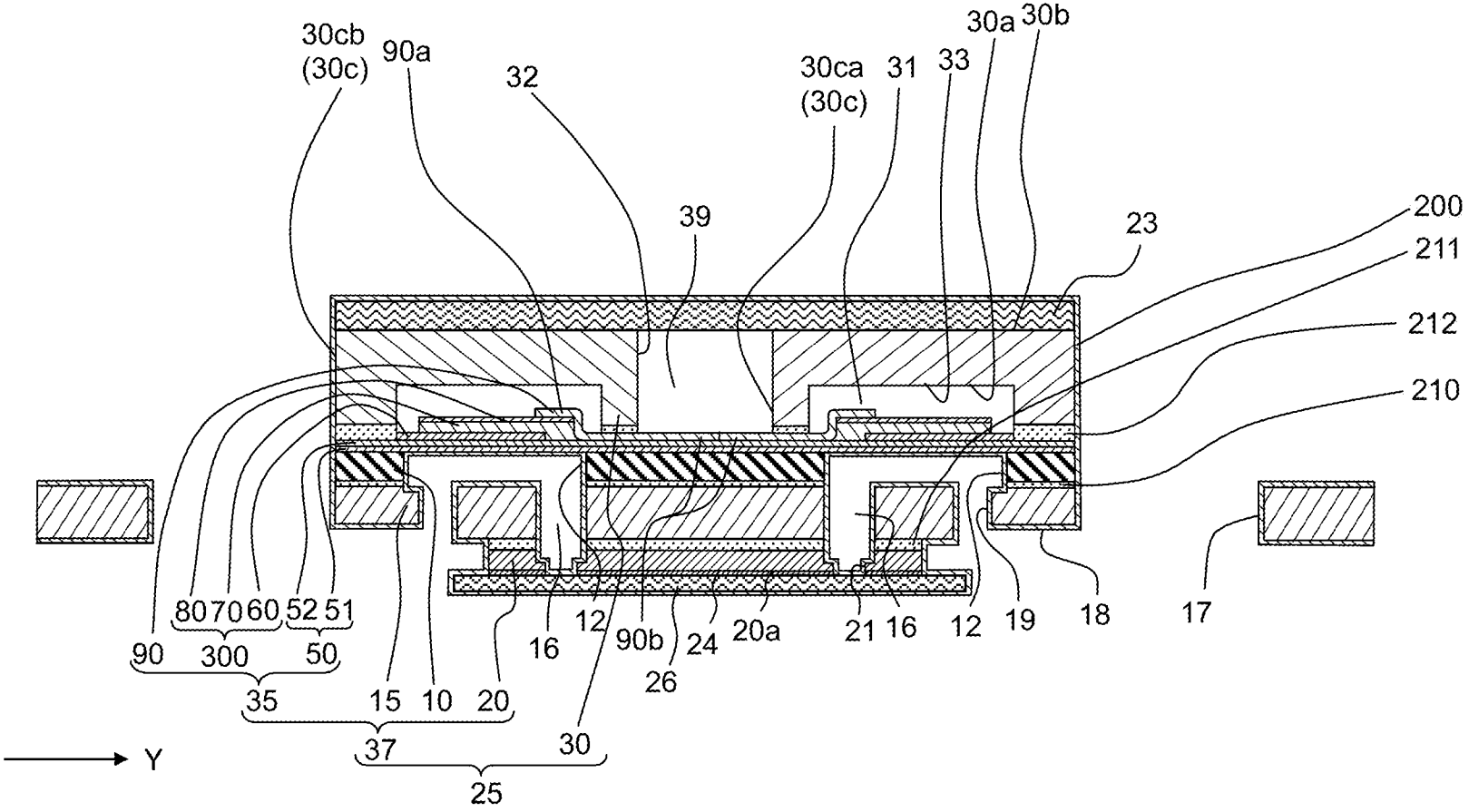
FIG. 10 is a view conceptually showing a process of forming a protective film.

As shown in FIG. 10, the protective film 200 is formed by the atomic layer deposition on the stacked body 25 provided with the first mask 23 and the second mask 26. Accordingly, the protective film 200 is formed on a portion of a surface of the stacked body 25 which is not covered by the first mask 23 or the second mask 26. Consequently, the openings 21, the communicating channel 16, the pressure generating chambers 12, the ink supply ports 19, a surface defining the second manifold 18 and the first manifold 17, and the first surface 30*ca* of the protective member 30 are covered by the protective film 200. In other words, the protective film 200 is formed on a surface of the stacked body 25 defining the liquid flow channel.

By forming the protective film 200 by the atomic layer deposition (ADL), it is possible to form the continuous protective film 200 on the inner wall of the liquid flow channel. It is possible to form the protective film 200 with substantially uniform film thickness and favorable coverage even on portions having a narrow width, such as the nozzle openings 21, the nozzle communicating channel 16, and the ink supply channel 19 and the inner wall of a portion having a complex shape such as the pressure generating chamber 12, the nozzle communicating channel 16, and the ink supply channel 19. With a method other than the atomic layer deposition, such as the sputtering method and the CVD method, it is difficult to form a protective film with a uniform thickness on a surface having a complex shape including a surface with a different direction and/or a surface at an inner side of a narrow opening.

Moreover, since the protective film 200 is formed continuously even on a surface of the adhesives 210 to 212 exposed inside (through) channel, it is possible to suppress an occurrence of an ink leakage, a jetting defect, and exfoliation of a member due to degradation of adhesion by the adhesives 210 to 212 being affected by a liquid such as ink.

Moreover, by forming the protective film 200 by the atomic layer deposition, it is possible to form the dense protective film 200 having a high film density. The protective film 200 having a high film density can improve the ink resistance (liquid resistance) of the protective film 200. That is, the protective film 200 being formed of at least one of the tantalum oxide ($TaO_X$), hafnium oxide ($HfO_X$), aluminum oxide ($AlO_X$), and zirconium oxide ($ZrO_X$), has ink resistance, and the ink resistance of the protective film 200 can be further improved by forming the protective film 200 by the atomic layer deposition. Accordingly, it is possible to prevent the elastic film 51 of the vibration plate 50, the channel substrate 10, the communicating plate 15, the nozzle plate 20, the protective member 30, and the adhesives 210 to 212 from being eroded (etched) by a liquid such as ink.

Moreover, since the protective film 200 formed by the atomic layer deposition has a film density higher than that of a protective film formed by a method such as the CVD, it is possible to secure an adequate ink resistance even with a thinner film thickness. Forming the protective film 200 with a comparatively thinner film thickness can reduce a degradation of a displacement amount of the vibration plate 50 due to an inhibition of the displacement of the vibration plate 50 by the protective film 200.

Moreover, since the protective film 200 suppresses the vibration plate 50 from being eroded by ink, it is possible to suppress an unevenness (a variation) in displacement characteristics of the vibration plate 50, and to deform the vibration plate 50 with stable displacement characteristics. Furthermore, since the protective film 200 formed on the vibration plate 50 has a substantially uniform film thickness, it is possible to suppress an occurrence of unevenness in the displacement characteristics of the vibration plate 50 due to an unevenness in the thickness of the protective film 200.

(8) Removing First Mask (A8)

Figure 11:
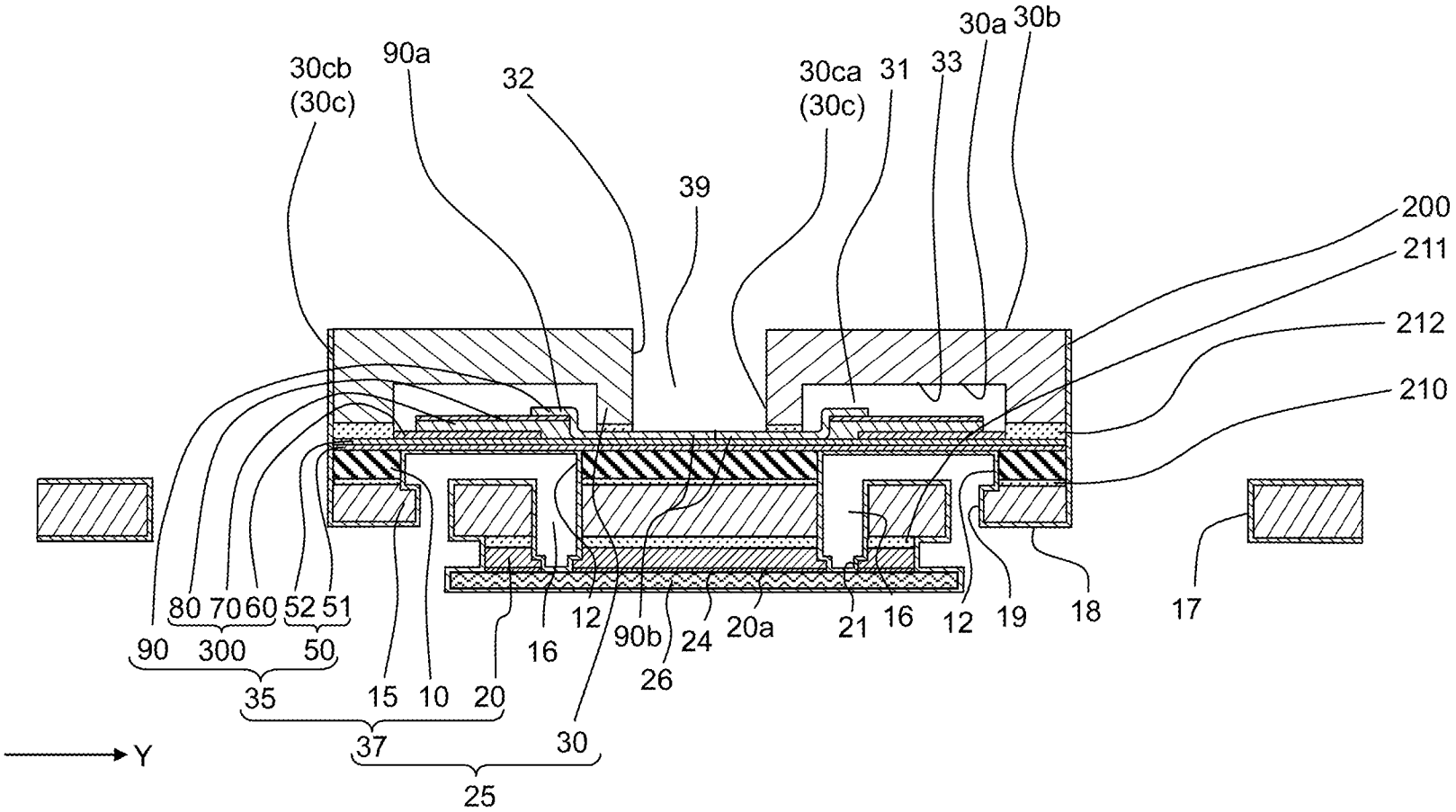
FIG. 11 is a view conceptually showing a process of removing the first mask.

The first mask 23 is removed as shown in FIG. 11. Accordingly, sealing of the first space 39 is released (the first space 39 is made to be unsealed). The first mask 23 may be peeled mechanically, or may be peeled by heating or by ultraviolet radiation.

(9) Removing Second Mask (A9)

Figure 12:
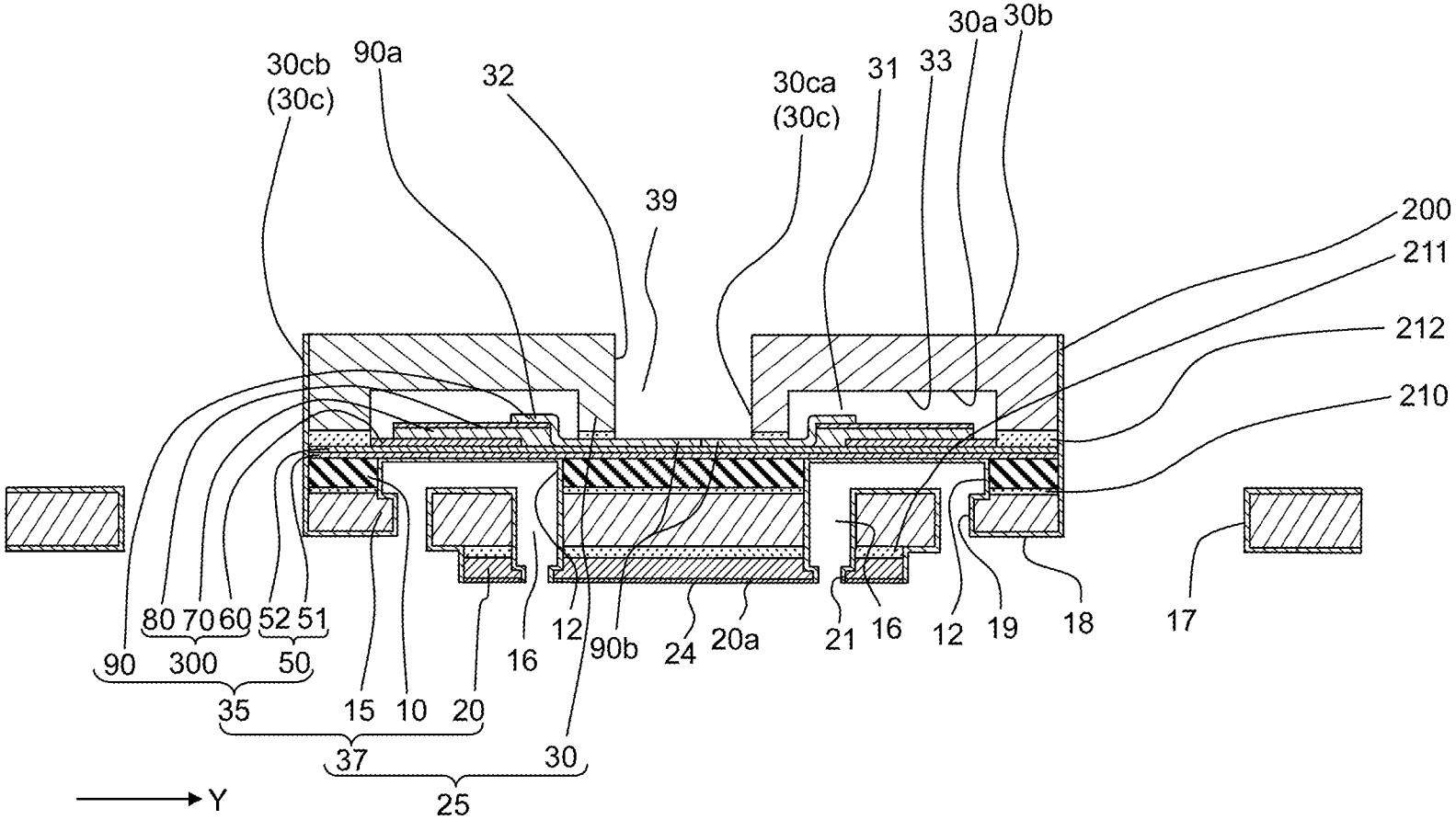
FIG. 12 is a view conceptually showing a process of removing the second mask.

The second mask 26 on the liquid jetting surface 20*a* of the stacked body 25 is removed as shown in FIG. 12. The second mask 26 may be peeled mechanically, or may be peeled by heating or by ultraviolet radiation.

(10) Connecting Trace and Circuit Board (A10)

Figure 13:
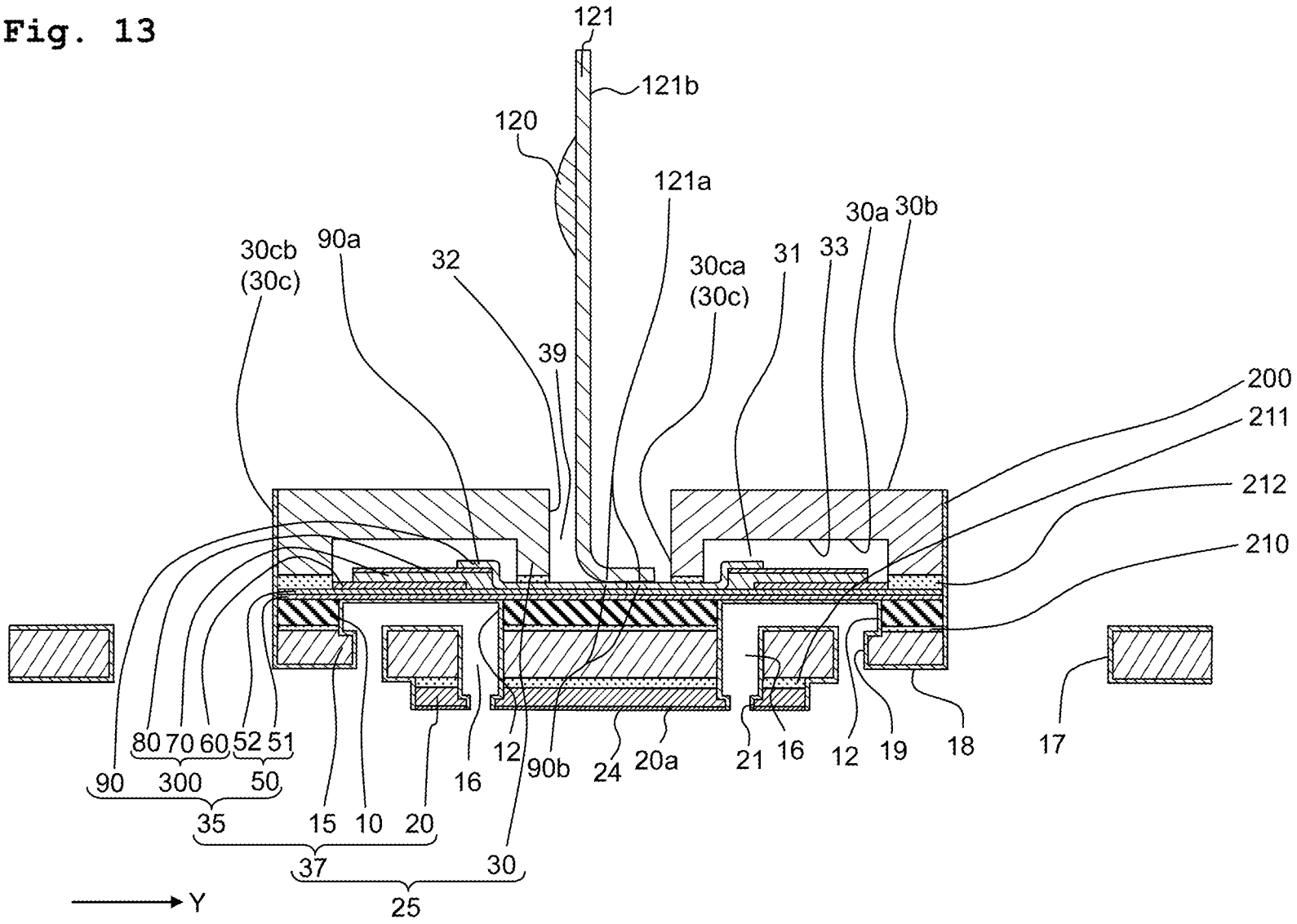
FIG. 13 is a view conceptually showing a process of connecting a trace and a circuit board.

As shown in FIG. 13, the second connecting terminal 90*b* of the lead electrode (trace) 90 and the connecting terminal 121*a* of the circuit board 121 are electrically connected in the through hole 32 or in other words, in the first space 39. The electrical connection may be established by an arbitrary method.

The lead electrode 90 and the circuit board 121 are connected after the formation of the protective film 200. Consequently, a surface of the circuit board 121 and a surface of the drive circuit 120 are not covered by the protective film 200. In a case in which the surface of the circuit board 121 is covered by the protective film 200, the connecting terminal 121*b* is required to be exposed by removing the protective film 200 on the connecting terminal 121*b* of the circuit board 121. However, since the surface of the circuit board 121 not being covered by the protective film 200 in the method of manufacturing liquid discharge head according to the present embodiment, there needs no time and labor for removing the protective film 200.

Moreover, if the protective film 200 is formed after the lead electrode 90 and the circuit board 121 are connected, there is a possibility that solder resist used for the drive circuit 120 and the circuit board 121 is degraded due to the high temperature during the protective film 200 formation, because the atomic layer deposition for forming the protective film 200 is carried out at a high temperature. In the method of manufacturing liquid discharge head according to the present embodiment, since the lead electrode 90 and the circuit board 121 being connected after the formation of the protective film 200, there is no degradation of the circuit board 121 and the drive circuit 120 due to the high temperature during the formation of the protective film 200.

(11) Stacking Compliance Substrate (A11)

Figure 14:
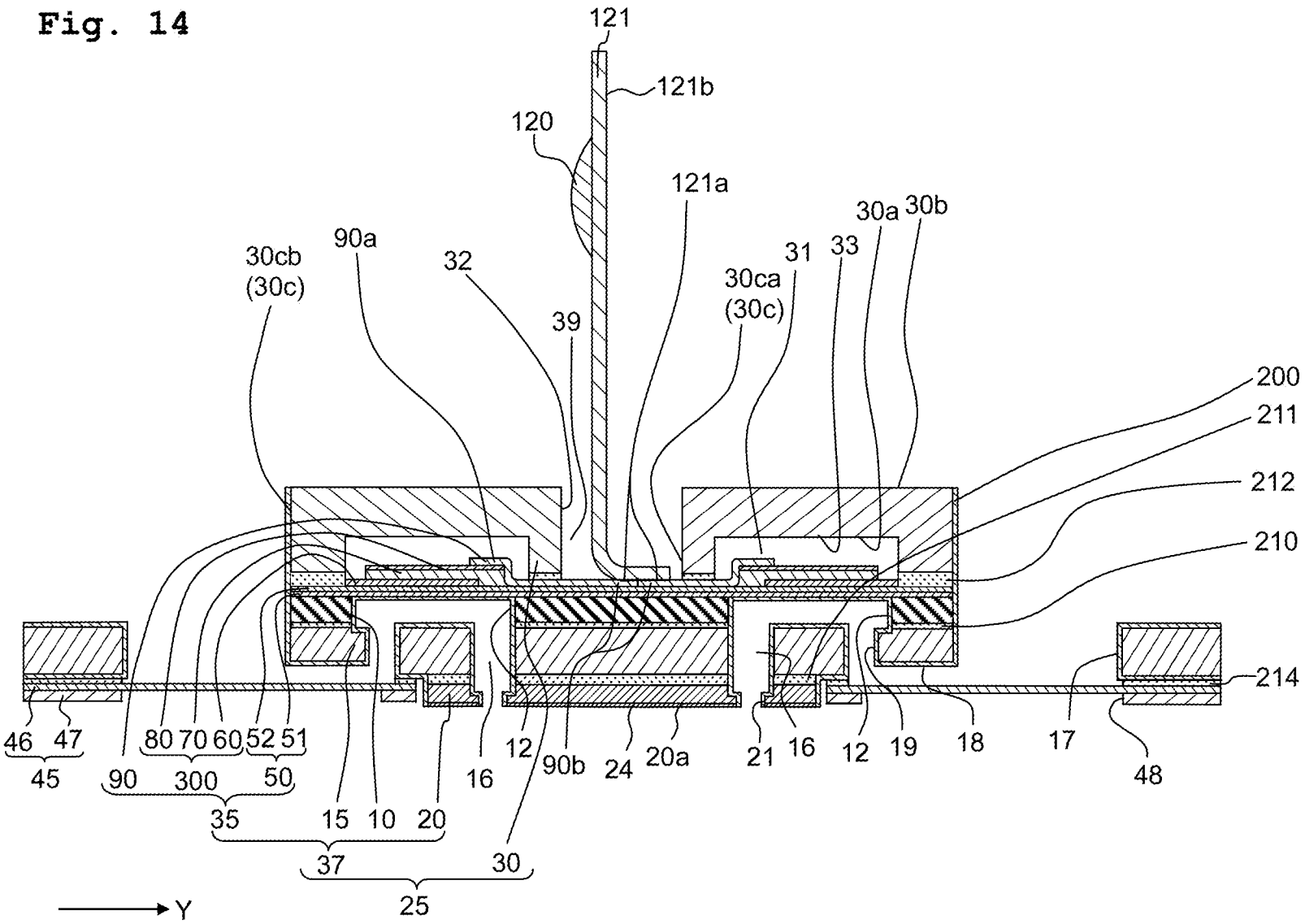
FIG. 14 is a view conceptually showing a process of stacking a compliance substrate.

The compliance substrate 45 is joined to the communicating plate 15 via an adhesive 214 as shown in FIG. 14.

(12) Stacking Case Member (A12)

Figure 15:
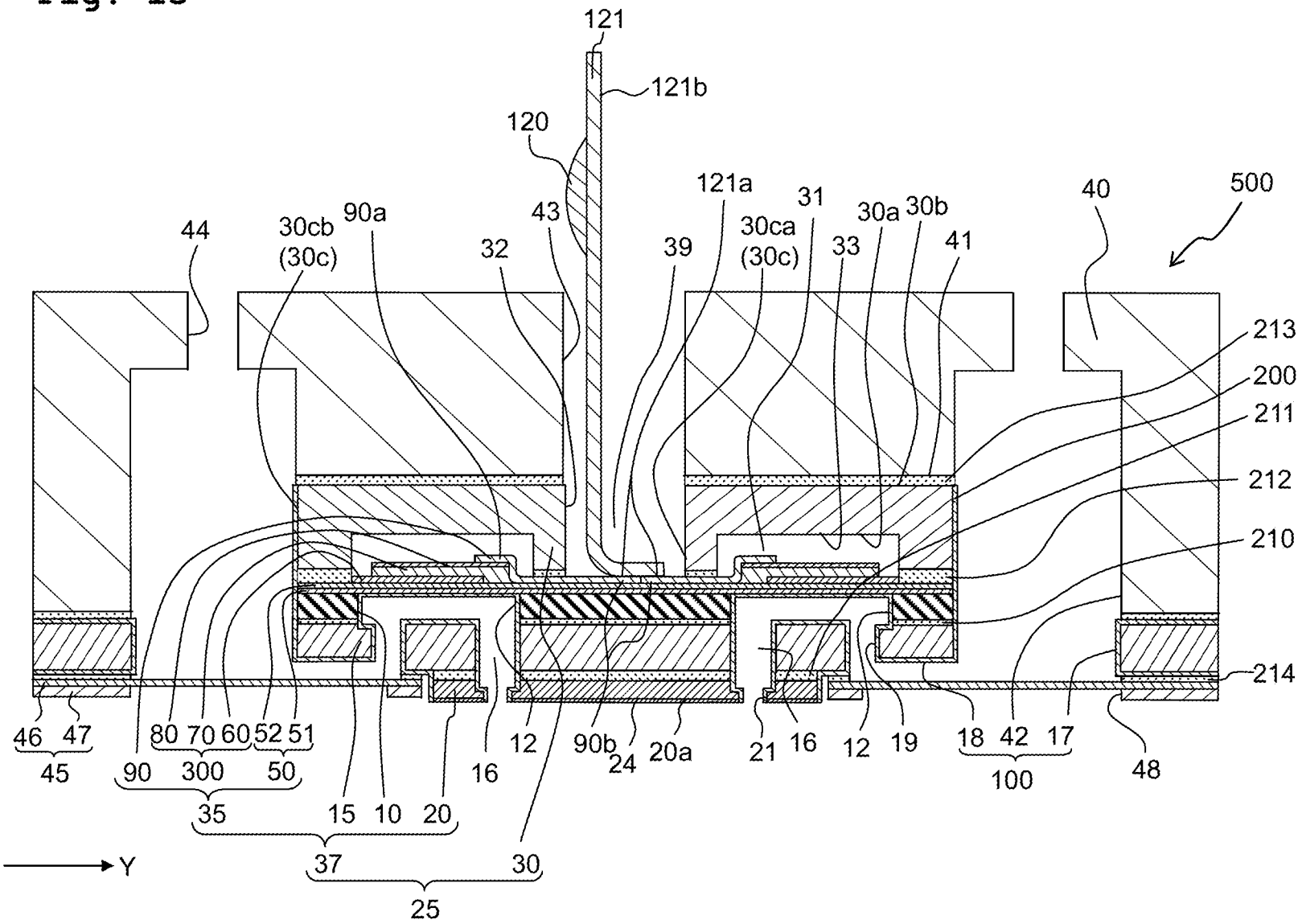
FIG. 15 is a view conceptually showing a process of stacking a case member.

The case member 40 is joined to the communicating plate 15 and the protective member 30 via the adhesive 213 as shown in FIG. 15.

The protective film 200 may be formed by the atomic layer deposition after joining the compliance substrate 45 and the case member 40.

As described heretofore, it is possible to manufacture the ink-jet recording head 500 as shown in FIG. 2A and FIG. 2B.

In the abovementioned manufacturing method, since the formation of the protective film 200 is carried out after the first space 39 positioned inside the through hole 32 of the protective member 30 has been sealed, the second connecting terminal 90*b* of the lead electrode 90 positioned in the first space 39 is not covered by the protective film 200. Consequently, since the protective film 200 does not exist between the lead electrode 90 and the circuit board 121, it is possible to connect electrically the lead electrode 90 to the circuit substrate 121.

The basic arrangement of the present teaching has been described heretofore. However, the method of manufacturing liquid discharge head of the present teaching is not limited to the abovementioned method.

In the abovementioned manufacturing method, the stacked body 25 is formed by preparing the protective member (A1), forming the device substrate (A2), stacking the device substrate and the protective member (A3), and forming the liquid flow channel (A4). Accordingly, the processes A1 to A4 in combination can be called as 'forming the stacked body 25'.

Moreover, providing the first mask (A5) may be carried out any time before the formation of the protective film (A7). For instance, in the formation of the liquid flow channel (A4), the first mask 23 may be provided on the upper surface 30*b* of the protective member wafer 130 after the pressure generating chamber 12 is formed by etching the channel substrate wafer 110, and thereafter, the channel substrate wafer 110 and the protective member wafer 110 may be divided (split) into one chip size. At this time, the first mask 23 is also divided (split) into one chip size simultaneously. Or, the protective member wafer 130 and the device substrate 35 may be stacked after the first mask 23 is provided on the upper surface 30*b* of the protective member wafer 130. In other words, providing the first mask 23 may be carried out during the formation of the stacked body 25 or may be carried out before or after forming the stacked body 25. It is preferable to provide the first mask 23 after grinding the channel substrate wafer 110 in the process of forming the liquid flow channel (A4), which makes it possible to grind the channel substrate wafer 110 with high accuracy.

Furthermore, providing the second mask (A6), removing the second mask (A9), connecting the connecting terminal of the circuit board to the trace (A10), stacking the compliance substrate (A11), and stacking the case member (A12) are not indispensable components (processes), but are arbitrary processes.

Figure 16:
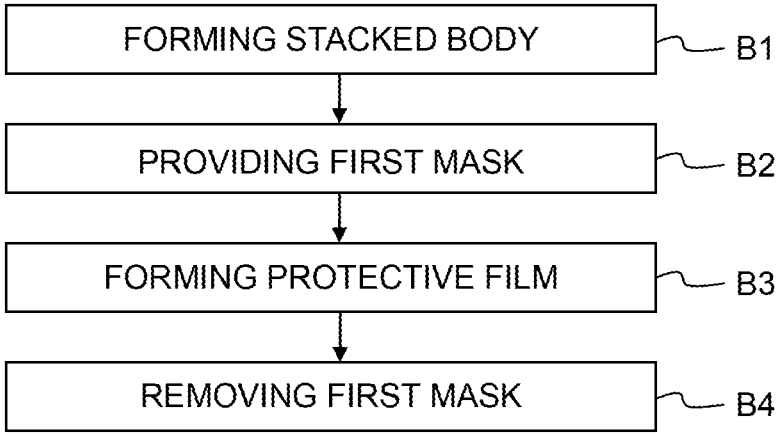
FIG. 16 is a flowchart showing a method of manufacturing liquid discharge head according to the embodiment.

Therefore, it is possible to express the method of manufacturing liquid discharge head by a flowchart shown in FIG. 16. The method of manufacturing the liquid discharge head shown in FIG. 16 includes forming the stacked body (B1), providing the first mask on the protective member (B2), forming the protective film on the surface defining the liquid flow channel by the atomic layer deposition (B3), and removing the first mask (B4). As mentioned above, providing the first mask (B2) may be carried out during the process of forming the stacked body (B1) or may be carried out before or after forming the stacked body (B1).

Providing the second mask (A6) mentioned above may be carried out any time before forming the protective film (A7). Moreover, removing the first mask (A8), removing the second mask (A9), connecting the trace and the circuit board (A10), stacking the compliance substrate (A11), and stacking the case member (A12) may be carried out any time after forming the protective film (A7). Connecting the trace and the circuit board (A10) may be carried out before stacking the case member (A12). This is because, in a case of connecting the trace and the circuit board after stacking the case member, a distance from an upper surface of the case member up to the connecting terminal of the trace for connecting to the circuit board being large, there is a possibility that adhering the trace and the circuit board with accuracy becomes difficult.

The recording head 501 according to the first modified embodiment shown in the abovementioned FIG. 2C is manufactured by forming the protective film 200*b* on the surface of the protective member 30 by the atomic layer deposition after the process of preparing the protective member 30 (A1) and before the process of stacking the protective member 30 and the device substrate 35 (A3). In this case, the protective film which is formed in the process of forming the protective film (A7, B3) becomes the first protective film 200*a*. The protective film 200*b* include at least one type of material from among tantalum oxide ($TaO_X$), hafnium oxide ($HfO_X$), aluminum oxide ($AlO_X$), and zirconium oxide ($ZrO_X$) as a main constituent. Particularly, from a view point of a coating effect (property) of the first protective film 200*a*, or in other words, from a view point of adhesion of the first protective film 200*a* and the second protective film 200*b*, the second protective film 200*b* may be formed of the same material as that of the first protective film 200*a*.

Figure 17:
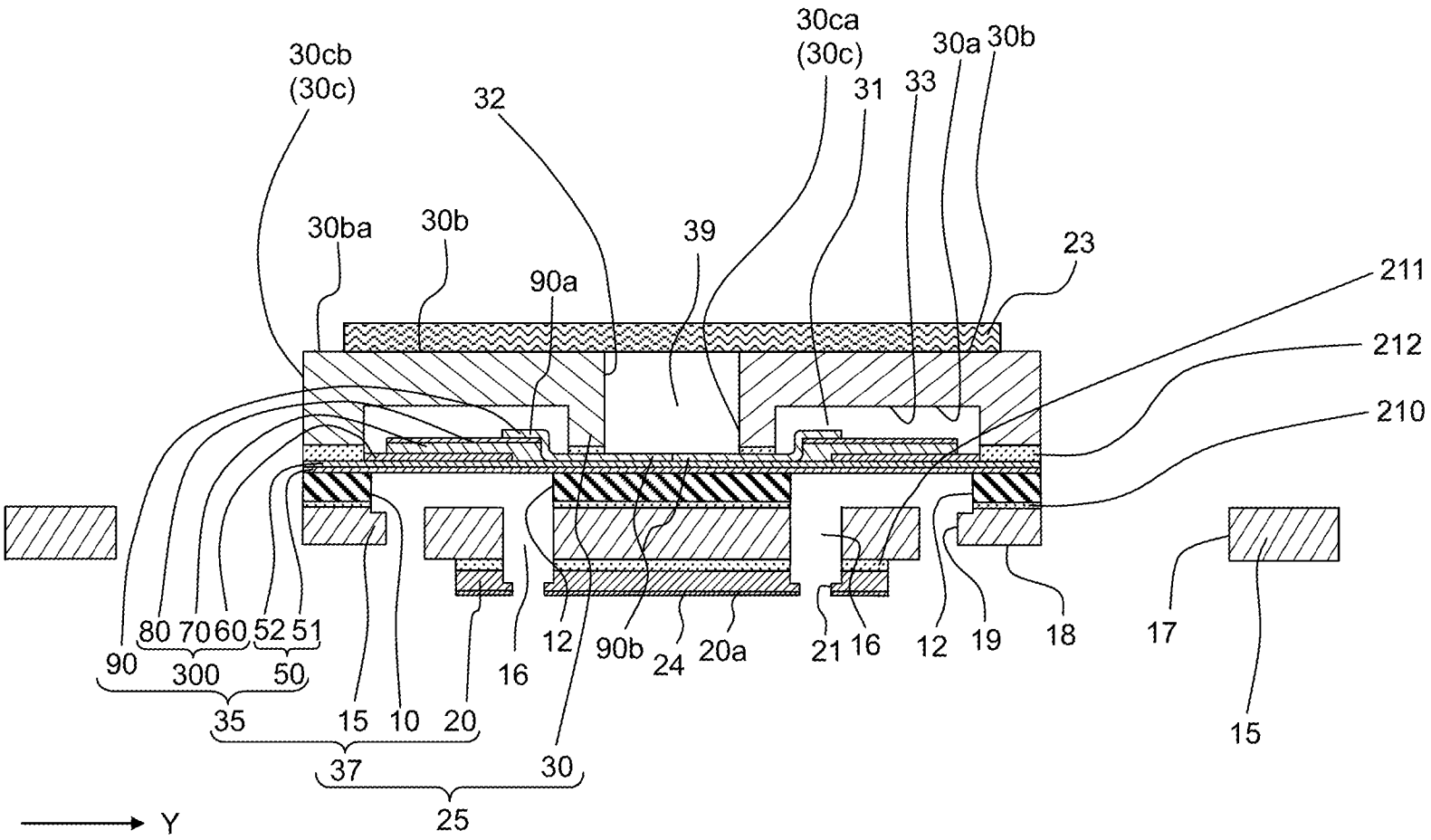
FIG. 17 is a view conceptually showing a process of forming a first mask in a method of manufacturing recording head according to the second modified embodiment.

The recording head 502 according to the second modified embodiment shown in FIG. 2D is manufactured by using a first mask 23*a* having a length in the second direction Y shorter than a length (width) in the second direction Y of the upper surface 30*b* of the protective member 30 as shown in FIG. 17. The first mask 23*a* is provided such that the first mask 23*a* does not cover the outer edge portion 30*ba* of the upper surface 30*b* of the protective member 30.

It is possible to manufacture the recording head 503 according to the third modified embodiment shown in FIG. 2E by forming the stepped portion 34 by processing the outer edge portion 30*ba* of the upper surface 30*b* of the protective member 30 into a stepped form by an anisotropic wet etching, the dry etching, etc. It is possible to form the stepped portion 34 at the time of the process of preparing the protective member 30 (A1) or at the time of dividing (splitting) the protective member wafer 130 into one chip size. In a case that the protective member wafer 130 is divided (split) by dicing after the stepped portion 34 has been formed, the stepped portion 34 can be used as an alignment for dicing. Moreover, the outer edge portion 30*ba* may be chamfered or filleted instead of forming the stepped portion 34.

In the abovementioned embodiment, the channel substrate 10 and the nozzle plate 20 are joined via the communicating plate 15, however, they are not limited to be joined in such manner. For example, the channel substrate 10 and the nozzle plate 20 may be joined directly. Moreover, a substrate other than the communicating plate 15 may be interposed between the nozzle plate 20 and the channel substrate 10.

In a case that the case member 40 is formed of a material that can be eroded by a liquid such as ink, a protective film formed by the atomic layer deposition may be provided to surfaces defining the introducing channel 44 and the third manifold 42 of the case member 40 and a surface that is to be adhered to the stacked body 25. This configuration makes it possible to prevent the case member 40 from being eroded by a liquid such as ink.

In the abovementioned embodiment, a piezoelectric actuator of a thin-film type has been used as the pressure generating means that makes ink droplets jetted from the nozzle openings 21. However, the pressure generating means is not limited to the piezoelectric actuator of thin-film type in particular. It is also possible to use piezoelectric actuators such as a piezoelectric actuator of a thick-film type formed by a method such as sticking (affixing) a green sheet and a piezoelectric actuator of a longitudinal vibration type in which a piezoelectric material and an electrode formation material are alternately stacked to expand and contract in an axial direction. Moreover, as the pressure generating means, an actuator in which a heater element is disposed in a pressure generating chamber, and the heater generates heat thereby generating bubbles, which make liquid droplets jetted from nozzle openings and a so-called electrostatic actuator in which static electricity is generated between a vibration plate and an electrode to deform the vibration plate, thereby jetting liquid droplets from nozzle openings.

Moreover, instead of the abovementioned protective member 30, a protective member not having a through hole may be used. For instance, two rectangular protective members having a long side in the first direction X may be arranged side-by-side in the second direction Y. In this case, the connecting terminal of the lead electrode 90 which is to be connected to the circuit board 121 may be disposed between the two protective members. Moreover, one protective member not having a through hole may be arranged to cover all piezoelectric elements of the recording head, for instance. In this case, the connecting terminal of the lead electrode 90 which is to be connected to the circuit board 121 may be arranged at an outer side of an outer periphery of the protective member.

Figure 18:
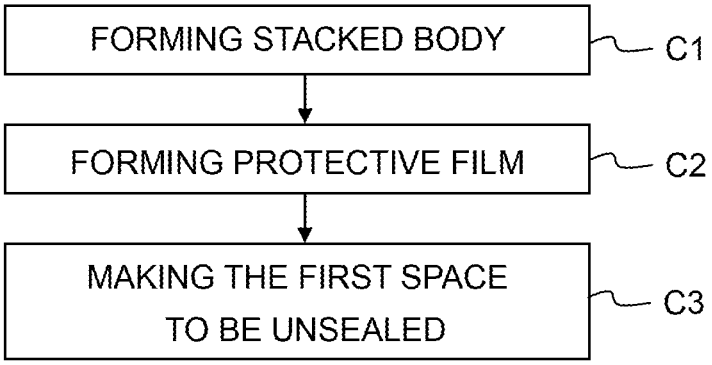
FIG. 18 is a flowchart showing a method of manufacturing a liquid discharge head according to the embodiment.

Moreover, it is also possible to express the method of manufacturing liquid discharge head according to the abovementioned embodiment by a flowchart shown in FIG. 18. The method of manufacturing liquid discharge head shown in FIG. 18 includes forming the stacked body (C1), forming the protective film (C2), and making the first space to be unsealed (releasing the seal) (C3).

Forming the stacked body (C1) corresponds to preparing the protective member (A1), forming the device substrate having the piezoelectric element and the trace (A2), stacking the device substrate and the protective member (A3), forming the liquid flow channel (A4), and providing the first mask (A5) in the abovementioned embodiment.

In the process of forming the stacked body (C1), a stacked body which includes the structure 37, the protective member 30, and the first mask 23 as shown in FIG. 8 is formed. The stacked body includes the piezoelectric element 300, the lead electrode 90 having the first connecting terminal 90*a* and the second connecting terminal 90*b*, and the liquid flow channel. Moreover, the stacked body has a first space 39, and two protective spaces 31 (a second space and a third space) arranged to sandwiched the first space 39 in the second direction Y. The first space 39, the second space, and the third space are either sealed separately, or, the second space and the third space are connected, and the second space and the third space that are connected and the first space are sealed separately. The piezoelectric element 300 is positioned on at least one of the two protective spaces 31, and is connected to the first connecting terminal 90*a* of the lead electrode 90 inside the protective space 31. The second connecting terminal 90*b* of the lead electrode 90 is positioned inside the first space 39.

Forming the protective film (C2) corresponds to forming the protective film (A7) in the abovementioned embodiment. In the process of forming the protective film (C2), the protective film 200 is formed on a surface of the stacked body defining the liquid flow channel by the atomic layer deposition.

Making the first space to be unsealed (C3) corresponds to removing the first mask (A8) in the abovementioned embodiment. In the process of making the first space to be unsealed, the seal of the first space 39 is released by removing the first mask 23 as shown in FIG. 11.

A method of manufacturing liquid discharge head expressed in a flowchart of FIG. 18 also includes the following modified embodiment.

In the process of forming the stacked body (C1) in the abovementioned embodiment, the stacked body which includes the structure 37, the protective member 30, and the first mask 23 is formed. However, in the present modified embodiment, a stacked body which includes a structure and a protective member is formed.

The protective member used in the present modified embodiment has a lower surface, an upper surface which is on an opposite side of the lower surface, and a lateral surface which is between the upper surface and the lower surface, and three recesses are formed in the lower surface. The three recesses include a first recess, and a second recess and a third recess that are arranged to sandwich the first recess.

The lower surface of the protective member is let to face the device substrate, and the protective member is joined to a piezoelectric element side of the device substrate. Accordingly, the first space is defined by the first recess and the device substrate, the second space is defined by the second recess and the device substrate, and the third space is defined by the third recess and the device substrate. The protective member and the device substrate are stacked such that the piezoelectric element and the first connecting terminal of the lead electrode which is connected to the piezoelectric element are positioned in at least one of the second space and the third space, and the second connecting terminal of the lead electrode is positioned in the first space. The first space, the second space, and the third space are sealed separately, or the second space and the third space are connected, and the second space and the third space that are joined and the first space, are sealed separately.

The process of forming the protective film (C2) is similar as in the abovementioned embodiment.

In the process of making the first space to be unsealed (C3), the seal of the first space is released by removing the first mask in the abovementioned embodiment, but in the present modified embodiment, the seal of the first space is released by making the first recess run through up to (penetrate to) the upper surface of the protective member. The first recess can be made to penetrate to the upper surface of the protective member by dry etching of the upper surface of the protective member, machining such as cutting, etc.

<Liquid Discharge Apparatus>

Figure 19:
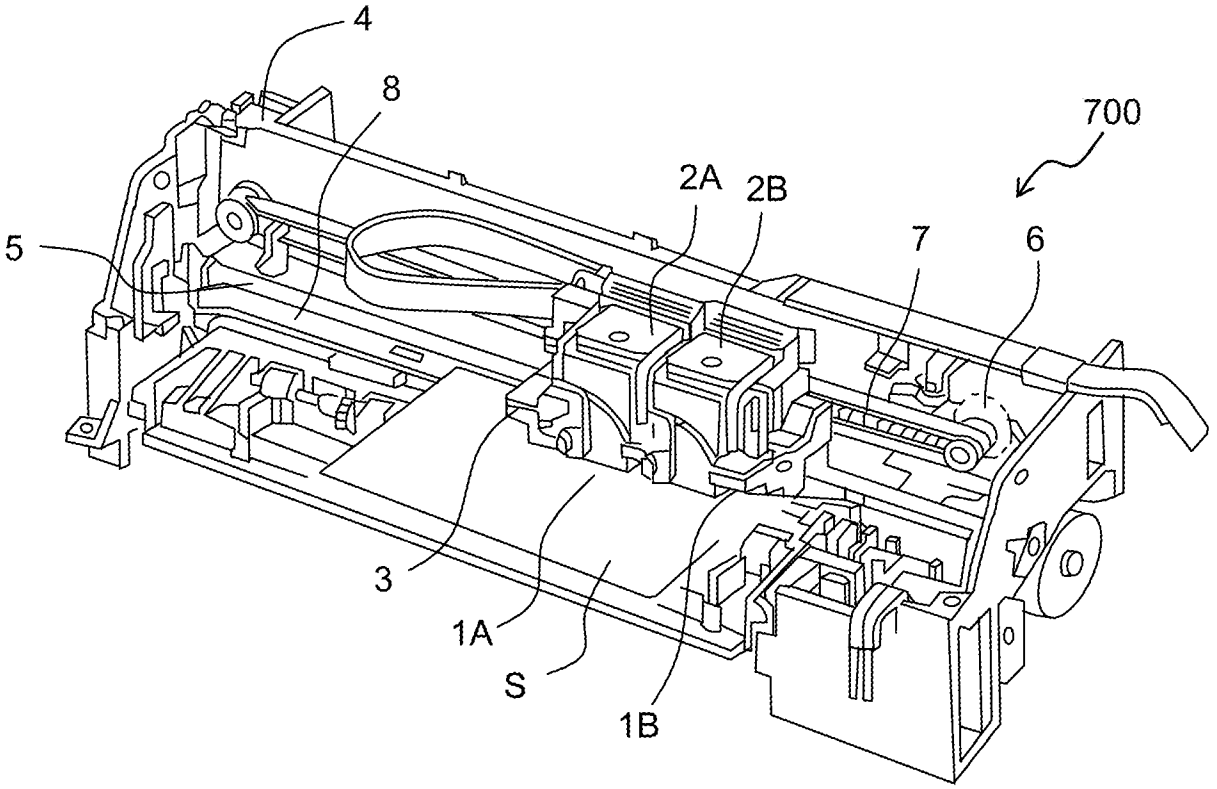
FIG. 19 is a schematic perspective view of a recording apparatus in which the recording head according the embodiment is used.

An ink-jet recording apparatus in which the abovementioned ink-jet recording head 500 is installed will be described below as an example of the liquid discharge apparatus. The ink-jet recording head forms a part of an ink-jet recording head unit provided with an ink flow channel communicating with a cartridge, etc., and is installed in the ink-jet recording apparatus. FIG. 19 is a schematic view showing an example of the ink-jet recording apparatus.

An ink-jet recording apparatus 700 shown in FIG. 19 includes an apparatus main body 4, a carriage shaft 5 which is attached to the apparatus main body 4, a carriage 3 which is provided to the carriage shaft 5 so as to move freely in an axial direction, ink-jet recording head units 1A and 1B (hereinafter, also referred to as recording head units 1A and 1B) installed on the carriage 3, a drive motor 6 which imparts a driving force for moving the carriage 3, and a platen 8 for transporting a recording sheet S by winding the recording sheet S around. The recording sheet S is a recording medium such as a paper which is supplied by a paper feeding roller not shown in the figure.

The recording head units 1A and 1B are provided with the ink-jet recording heads 500. Moreover, cartridges 2A and 2B which are ink supplying means are detachably provided to the recording head units 1A and 1B. As an example, the recording head units 1A and 1B jet a black-ink composition and a color-ink composition respectively.

The driving force of the drive motor 6 is transmitted to the carriage 3 via gears that are not shown in the figure and a timing belt 7, thereby moving the carriage 3 along the carriage shaft 5. On the other hand, the platen 8 is provided along the carriage shaft 5 to the apparatus main body 4, and the recording sheet S is transported by being wound around the platen 8.

In the abovementioned the ink-jet recording apparatus 700, the ink-jet recording head 500 (the recording head units 1A and 1B) is installed on the carriage 3 and moves in a main scanning direction. However, the arrangement is not limited to such an arrangement. As an example, the liquid discharge head according to the embodiment is also applicable to a so-called line recording apparatus in which, the ink-jet recording head 500 is fixed and printing is carried out with moving the recording sheet S in a sub-scanning direction.

Moreover, although the ink-jet recording apparatus 700 has an arrangement in which the cartridges 2A and 2B that are liquid storage means are installed on the carriage 3 in the abovementioned example, the arrangement is not limited to such an arrangement. For example, the liquid storage means such as an ink tank may be fixed to the apparatus main body 4, and the liquid storage means and the recording head 500 may be connected via a supply pipe such as tube. Moreover, the liquid storage means need not be installed on the ink-jet recording apparatus 700.

Although the description was made by citing the ink-jet recording head as an example of the liquid discharge head and the ink-jet recording apparatus as an example of the liquid discharge apparatus, the present teaching is intended for a broad range of liquid discharge heads, and is also applicable to other liquid discharge heads that jet liquids other than ink. The examples of the other liquid discharge heads include, various recording heads used in image recording apparatuses such as printers, color-material discharge heads used for manufacturing color filters for liquid crystal displays, etc., electrode-material discharge heads used for forming electrodes for organic EL (electro luminescence) displays, FED (field emission display), etc., and bio-organic material discharge heads used for manufacturing bio-chips.

What is claimed is:

1. A liquid discharge head, comprising:

a vibration plate;

a piezoelectric element provided on the vibration plate;

a trace formed on the vibration plate and having a first connecting terminal and a second connecting terminal; and a protective member provided on the vibration plate and configured to protect the piezoelectric element, wherein the protective member has a lower surface facing the vibration plate, an upper surface on a side opposite to the lower surface, and a lateral surface between the lower surface and the upper surface, the lower surface of the protective member has a recess, the piezoelectric element is accommodated in a protective space defined by the recess and the vibration plate, the lateral surface of the protective member has a first surface and a second surface facing the first surface with the protective space being interposed therebetween, the first connecting terminal of the trace is connected to the piezoelectric element in the protective space, the first surface of the protective member is positioned between the first connecting terminal and the second connecting terminal of the trace, a protective film is formed on the second surface of the protective member, and the protective film is not formed on the first surface of the protective member;

the liquid discharge head further comprising a circuit board connected to the second connecting terminal of the trace, wherein the circuit board is spaced apart from the first surface of the lateral surface of the protective member.

2. The liquid discharge head according to claim 1, wherein the protective film is not formed on the upper surface of the protective member.

3. The liquid discharge head according to claim 1, wherein the protective film is formed on an outer edge of the upper surface of the protective member.

4. The liquid discharge head according to claim 1, wherein a stepped portion or a chamfered portion is provided to an outer edge on the upper surface of the protective member, and the stepped portion or the chamfered portion is covered by the protective film.

5. The liquid discharge head according to claim 4, further comprising a case member having a recess which accommodates the protective member, wherein a portion, of the protective film, covering the stepped portion or the chamfered portion of the protective member is joined to the case member via an adhesive layer.

* * * * *